US005816152A

United States Patent [19]

Nelgner et al.

[11] Patent Number: 5,816,152

[45] Date of Patent: Oct. 6, 1998

[54] RECONFIGURABLE PRINTING PRESS

[75] Inventors: William James Nelgner, St. Charles; Joseph Randall Wiegner, Manchester; David Allen Langenberg, Union; Stephen George Palmer, Kirkwood; William Allen McCroskey, House Springs; Gary Wilson Teeter, St. Louis; Leonard Ronald Sanker, Foristell; Martin Alan Ross, Hazelwood, all of Mo.; Steven Michael Dods, Bellville, Ill.

[73] Assignee: Delaware Capital Formation, Inc., Wilmington, Del.

[21] Appl. No.: 922,025

[22] Filed: Sep. 2, 1997

[51] Int. Cl.[6] ..... B41F 5/06; B41F 5/16; B41F 13/02

[52] U.S. Cl. ..... 101/181; 101/484; 101/485

[58] Field of Search ..... 101/183, 181, 101/180, 178, 179, 182, 184, 152, 153, 216, 136, 137, 177, 138, 139, 140, 143, 484, 485

[56] References Cited

U.S. PATENT DOCUMENTS

| | | | |
|---|---|---|---|
| 1,782,608 | 11/1930 | Fulk . | |
| 2,479,023 | 8/1949 | Peyrebrune et al. | 101/183 |
| 3,440,900 | 4/1969 | Neal | 74/665 |
| 3,561,654 | 2/1971 | Greiner | 226/25 |
| 3,633,495 | 1/1972 | Brno et al. . | |
| 3,633,504 | 1/1972 | Chambon | 101/228 |
| 3,934,505 | 1/1976 | Kushner | 101/129 |
| 3,963,902 | 6/1976 | Dowd | 235/92 |
| 4,038,921 | 8/1977 | Harrison et al. | 101/183 X |
| 4,384,522 | 5/1983 | Ehlers et al. | 101/177 |
| 4,417,516 | 11/1983 | Fischer | 101/181 |
| 4,528,630 | 7/1985 | Sargent | 364/469 |
| 4,722,275 | 2/1988 | Taguchi et al. | 101/228 |
| 4,805,111 | 2/1989 | Steidel | 364/469 |
| 4,852,785 | 8/1989 | Bettendorf et al. | 226/42 |
| 4,899,655 | 2/1990 | Seo et al. | 101/181 |
| 5,060,569 | 10/1991 | Gladow | 101/216 |
| 5,117,753 | 6/1992 | Mamberer | 101/225 |
| 5,213,033 | 5/1993 | Bourgeois et al. | 101/116 |
| 5,247,882 | 9/1993 | Zook et al. | 101/120 |
| 5,259,307 | 11/1993 | Bourgeois et al. | 101/118 |
| 5,347,926 | 9/1994 | Fantoni et al. | 101/219 |
| 5,392,710 | 2/1995 | Li | 101/219 |
| 5,528,986 | 6/1996 | Andersson et al. | 101/219 |
| 5,528,987 | 6/1996 | Andersson et al. | 101/219 |

*Primary Examiner*—J. Reed Fisher
*Attorney, Agent, or Firm*—Foley & Lardner

[57] ABSTRACT

A reconfigurable web processor, comprising: a first and a second base modules, each of the base modules including an external surface with at least one alignment structure disposed on the external surface; a plurality of pacing rolls, with a different one of the plurality of pacing rolls associated with each of the base modules to adjust the pace of a web moving within the associated base module; a plurality of transducers, with a different one of the plurality of transducers associated with a different one of the base modules and disposed to monitor a characteristic of the web at said associated base module and to generate a transducer signal in accordance therewith; a plurality of pacing servos, with a different one of the plurality of pacing servos associated with each different one of the pacing rolls, each of the pacing servos to adjust the pace of the web in accordance with a different pacing control signal for its associated the pacing roll; and a process head drive disposed to drive a drive roll in a portable process head that may be disposed on the respective external surface of the base modules in registry with the at least one alignment structure of the respective base modules.

41 Claims, 22 Drawing Sheets

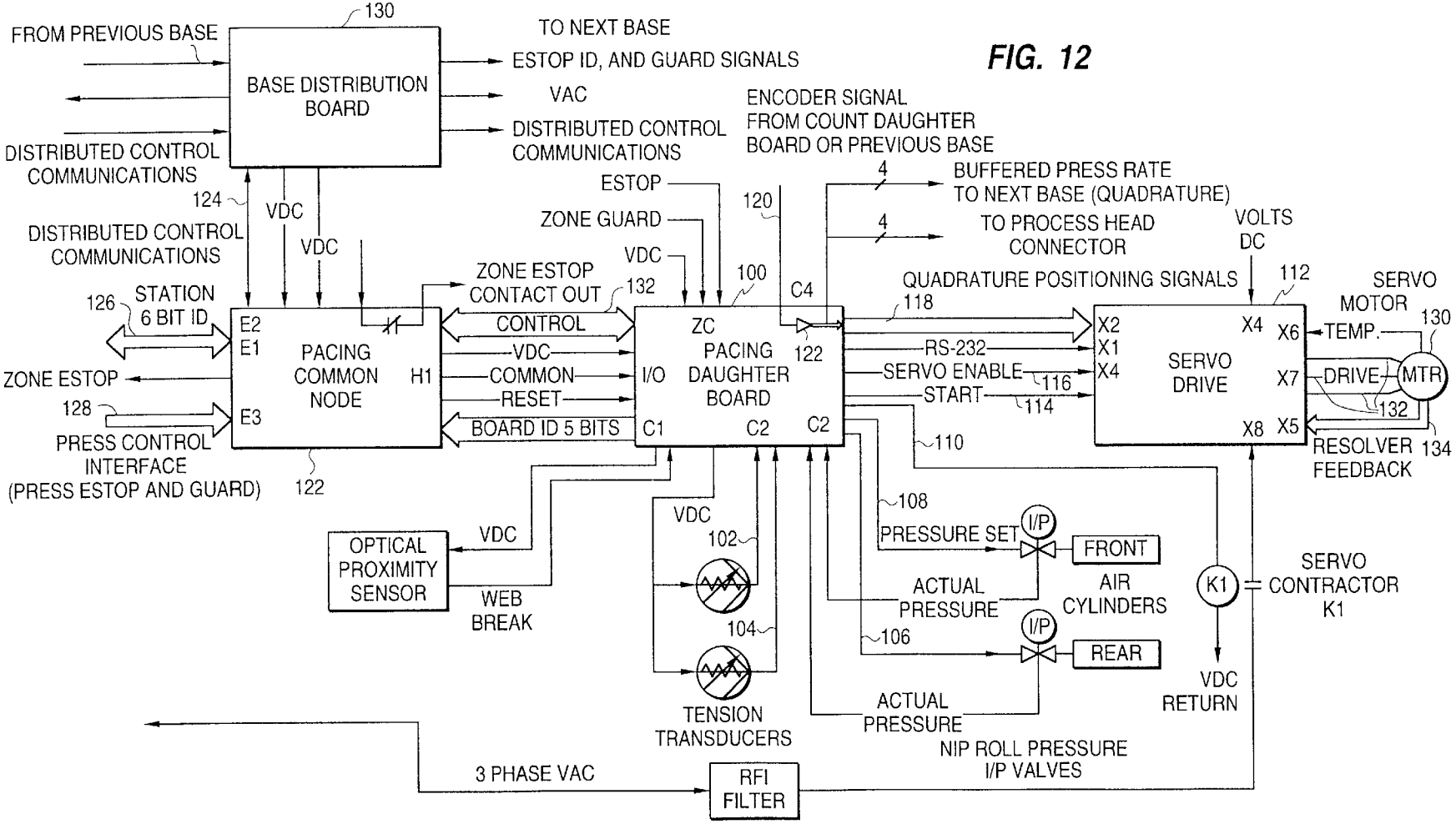
FIG. 12
SERVO MOTOR
TEMP.
DRIVE
MTR
RESOLVER FEEDBACK
SERVO CONTRACTOR K1
VOLTS DC
SERVO DRIVE
X4
X6
X7
X5
X8
X2
X1
X4
K1
VDC RETURN
BUFFERED PRESS RATE TO NEXT BASE (QUADRATURE)
TO PROCESS HEAD CONNECTOR
QUADRATURE POSITIONING SIGNALS
FRONT
AIR CYLINDERS
REAR
I/P
PRESSURE SET
ACTUAL PRESSURE
NIP ROLL PRESSURE I/P VALVES
RS-232
SERVO ENABLE
START
ENCODER SIGNAL FROM COUNT DAUGHTER BOARD OR PREVIOUS BASE
C4
C2
ZC
PACING DAUGHTER BOARD
I/O
C1
VDC
TENSION TRANSDUCERS
RFI FILTER
TO NEXT BASE
ESTOP ID, AND GUARD SIGNALS
VAC
DISTRIBUTED CONTROL COMMUNICATIONS
ESTOP
ZONE GUARD
ZONE ESTOP CONTACT OUT
CONTROL
COMMON
RESET
BOARD ID 5 BITS
WEB BREAK
3 PHASE VAC
BASE DISTRIBUTION BOARD
PACING COMMON NODE
H1
OPTICAL PROXIMITY SENSOR
E2
E1
E3
FROM PREVIOUS BASE
DISTRIBUTED CONTROL COMMUNICATIONS
STATION 6 BIT ID
ZONE ESTOP
PRESS CONTROL INTERFACE (PRESS ESTOP AND GUARD)
100
102
104
106
108
110
112
114
116
118
120
122
124
126
128
130
132
134

RECONFIGURABLE PRINTING PRESS

BACKGROUND OF THE INVENTION

Field of the Invention

Briefly, the present invention relates to a reconfigurable web processor, and more particularly, to a modular web processor that utilizes a plurality of modular process stations.

Portable process heads are essential in the narrow web printing industry to allow the operator the versatility to reconfigure a press to perform the many types of jobs now required in the printing industry. The ability to move any one of a variety types of printing heads to any location in a press or web processor is an essential feature, especially if it can be performed in a timely manner.

A variety of presses are on the market that have portable process heads to perform various printing processes. These portable process heads can be moved to any location within a printing zone. The printing presses that offer such portable process heads typically require the operator to disconnect the electrical power, the electrical control lines, the pneumatics, the drive gears and the dryer hoses, in order to remove the head and then to reconnect a new process head to all of those lines. This process can be very time consuming and not very operator friendly, particularly when the printing press has ink spills or other contamination thereon.

In addition to these problems relating to the disconnection and reconnection of portable process heads, there is a fundamental limit on the extensibility of this portability feature to nonprinting process functions, such as, for example, diecutting functions. This fundamental limitation arises because of a requirement to stage roll diameters progressively from small diameters to large diameters as the web moves from one end of the web processing or printing press function system to the other. Specifically, pacing roll diameters in most presses must be at least equal to or greater than the previous pacing roll from the in-feed to the exit end of the press. This "staging" is important in order to maintain the desired tension on the web. The "staging" requirement thus prevents the substitution of a diecutting process head for a printing process head because of the difference in pacing roll diameters.

SUMMARY OF THE INVENTION

The present invention, in one embodiment thereof, is a reconfigurable web processor, comprising a first and a second base modules, each of the base modules including an external surface with at least one alignment structure disposed on the external surface; a plurality of pacing rolls, with a different one of the plurality of pacing rolls associated with each different base module to control the pace of a web moving within the associated base module; and a plurality of transducers, with a different one of the plurality of transducers associated with each different base module and disposed to monitor a characteristic of the web at the associated base module and to generate a transducer signal in accordance therewith. The web processor further includes a plurality of pacing servos, with a different one of the plurality of pacing servos associated with each different one of the pacing rolls, each of the pacing servos to adjust the pace of the web in accordance with a different pacing control signal generated, and based, in part on the transducer signal for its associated pacing roll. The web processor further includes a process head drive disposed to drive a drive roll in a portable process head that may be disposed on the respective external surface of the base modules in registry with the at least one alignment structure of the respective base modules.

The reconfigurable web processor of the present invention may further include a control module connected to receive the transducer signal from the transducer at each of the base modules and operating to generate and provide a different pacing control signal to the servo associated with each of the different pacing rolls to individually adjust the pacing of the web at each of the base modules.

In a further aspect of the present invention, the reconfigurable web processor may include a different control module associated with each of the base modules, with each control module receiving the transducer signal from the associated transducer at the associated base module and operating to generate a pacing control signal and connected to apply the pacing control signal to the servo associated with the base module to adjust the pacing of the web at the associated base module. Each of these control modules may include a circuit to receive an input indicative of the diameter of the associated pacing roll for the associated base module and to receive an input indicative of a desired gain for the associated pacing roll, and wherein the control module generates the pacing control signal, in part, based on the diameter input and the desired gain input.

The web processor may further include a first portable process head for providing a first processing to the web, with the first process head including a drive roll and an external surface and an alignment registry structure on the external surface for fitting in registry with the alignment structure of any of the base modules. The first portable process head is disposed on the external surface of one of the first and second base modules, with its registry structure fitted and in registry with the alignment structure of the base module. A second portable process head is provided for performing a second processing to a web, with the second process head including an external surface and an alignment structure on the external surface for fitting in registry with the alignment structure of any of the base modules, with the second portable process head disposed on the external surface of the other of the first and second base modules, with its registry structure fitted and in registry with the alignment structure of the base module.

In a preferred embodiment of the present invention, the external surface on each of the base modules is a substantially horizontal top external surface of the base module.

In a further aspect of the present invention, the at least one alignment structure on the external surface of the base module may comprise a plurality of pins protruding from the external surface.

In yet a further aspect of the present invention, each of the base modules may comprise an electrical switch structure for an electrical switch, with the electrical switch structure disposed on the external surface and designed to switch the electrical switch to provide electrical power to the process head only when the portable process head is disposed on the external surface of the base module and aligned in registry with the at least one alignment structure.

In yet another aspect of the present invention, a pacing drive shaft is provided for driving each of the pacing rolls. A plurality of pacing roll gear boxes is also provided, with a different one of the plurality of pacing roll gear boxes associated with each different one of the pacing rolls and connected to apply a drive from the pacing drive shaft to its associated pacing roll. In this configuration the servo associated with each different one of the pacing rolls is operatively connected to the gear box associated with the pacing roll to adjust the pace of the web at the associated base module.

In yet another aspect of the present invention, the process head drive may comprise a main drive shaft operatively connected to drive a plurality of drive rolls.

In yet another aspect of the present invention, the process head drive may comprise a plurality of servomotors, with a different one of the servomotors associated with each different one of the base modules to apply a drive to a drive roll in a portable process head.

In yet another embodiment of the present invention, a portable process head is provided for performing processing on a web, comprising a frame, a drive roll disposed within the frame for driving a web, an external surface including an alignment registry structure therein for fitting in registry with an alignment structure on an external surface of a base module, and a recess formed in the alignment registry structure to receive an electrical switch structure from the base module, which electrical switch structure is moved laterally relative to the external surface into the recess at registry. This embodiment further comprises a positive stop disposed in the alignment structure.

In yet a further embodiment of the present invention, a method is provided for automatically controlling the pacing in a modular web processor, comprising the steps of: positioning a plurality of base modules to sequentially receive a continuous web; mating portable process heads having substantially the same alignment structures thereon onto different ones of the plurality of base modules to process the web; driving drive rolls in each of the portable process heads; monitoring a characteristic of the web at each of the base modules and generating a first signal in accordance therewith; and individually adjusting the pace of a pacing roll at each of the base modules in accordance with an individual control signal generated for that pacing roll based, in part, on the first signal generated for that base module.

In a further aspect of this embodiment, the completion of the process head mating step for one of the base modules automatically switches the electrical power to that process head.

In yet a further aspect of this embodiment, each of the base modules and each of the processed heads includes at least one functional control module, and the method further comprises the step of causing each of the functional control modules to generate and send to a main control module an I.D. signal identifying itself and a signal identifying what other functional control modules that the functional control module desires to communicate with.

In yet a further embodiment of the present invention, a reconfigurable web processor is provided, comprising: a first and a second base modules, each of the base modules including an external surface with at least one alignment structure disposed on the external surface; a plurality of pacing rolls, with a different one of the plurality of pacing rolls associated with a different one of the base modules to adjust the pace of a web moving within the associated base module; a plurality of transducers, with a different one of the plurality of transducers associated with a different one of the base modules and disposed to monitor a characteristic of the web at the associated base module and to generate a transducer signal in accordance therewith; a plurality of pacing servos, with a different one of the plurality of pacing servos associated with a different one of the pacing rolls, each of the pacing servos to adjust the pace of the web in accordance with a different pacing control signal generated, and based, in part, on the transducer signal for its associated pacing roll. The processor further comprises a first portable process head for providing a first processing to the web, the first process head including a drive roll and an external surface and an alignment registry structure on the external surface for fitting in registry with the alignment structure of any of the base modules, the first portable process head disposed on the external surface of one the first and second base modules, with its registry structure fitted and in registry with the alignment structure of the base module; and a second portable process head for providing a second processing to the web, the second process head including an external surface and an alignment structure on the external surface for fitting in registry with the alignment structure of any of the base modules, the second portable process head disposed on the external surface of the other of the first and second base modules, with its registry structure fitted and in registry with the alignment structure of the other of the base modules. The processor yet further comprises a central control module connected to electronically communicate with each of the base modules and with each of the process heads; wherein each of the base modules includes at least one functional control module; wherein each of the process heads includes at least one functional control module; further comprising a control system operative on power-up of the system, to cause each of the functional control modules in the system to generate and send to the main control module an ID signal identifying itself to the main control module and to generate and send a signal identifying what other of the functional control modules that the each functional control module will communicate with; wherein the central control module is operative to generate an indication of whether the web processor is functional based on at least the signals from the functional control modules.

BRIEF DESCRIPTION OF THE DRAWINGS

FIG. 12 is a schematic block diagram of a control module that may be used to control the pacing at a base module.

DETAILED DESCRIPTION OF THE PREFERRED EMBODIMENTS

Figure 1:
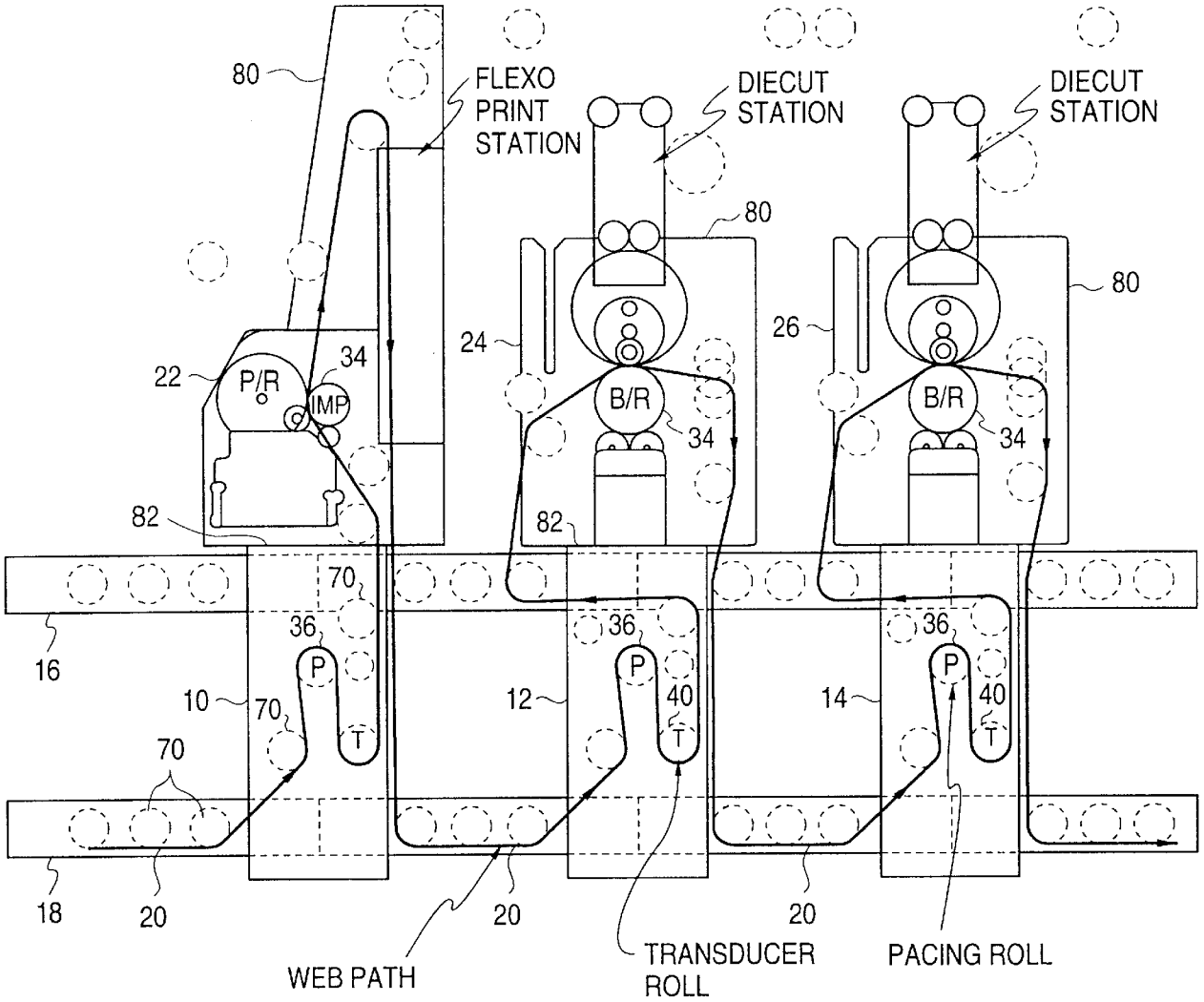
FIG. 1 is a schematic diagram of one embodiment of the present invention.
Figure 2:
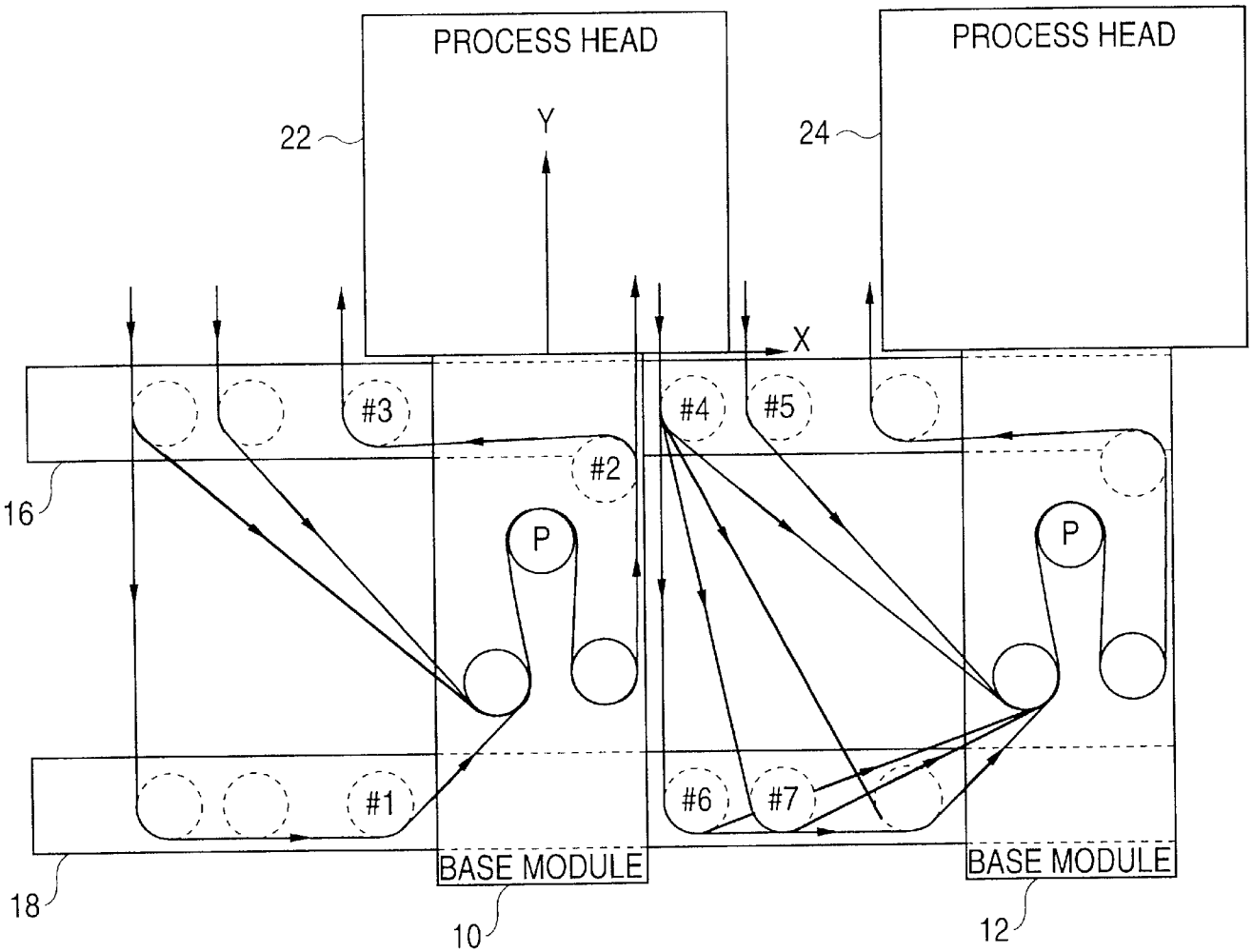
FIG. 2 is a schematic diagram of details of one embodiment of the base module of the present invention.

Referring now to FIGS. 1–13, a preferred embodiment of the present invention is disclosed. The invention comprises, in one aspect, a plurality of base modules. In FIG. 1, a base module 10, a base module 12, and a base module 14 are shown. The base modules 10, 12 and 14 are positioned in a line, by means of tie bars 16 and 18 to sequentially receive a continuous web 20. The base modules 10–14 are designed, in a preferred embodiment, to be substantially identical in design, in order to receive and mate with a variety of portable, interchangeable different process heads. By way of example only, in FIG. 1, a flexo print station 22 is shown mated with the base module 10. A diecut station process head 24 is shown mated with the base module 12. A diecut station 26 is shown mated with the base module 14. It should be understood that a portable process head to perform any desired function may be mated with the base modules 10–14, provided that appropriate alignment registry structures are disposed on the process head external mating surface.

Figure 3:
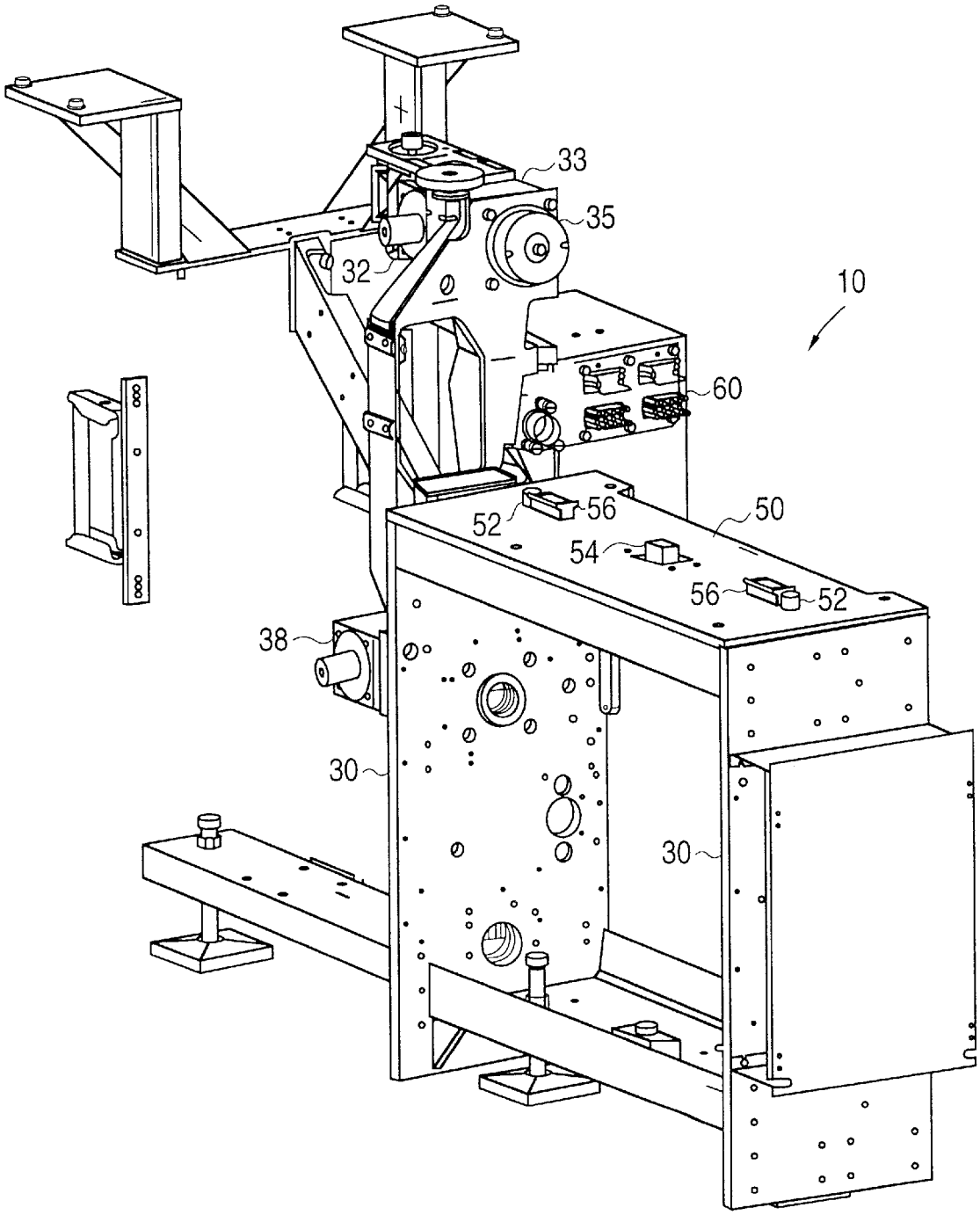
FIG. 3 is a perspective view of one embodiment of the base module of the present invention without rolls.
Figure 4:
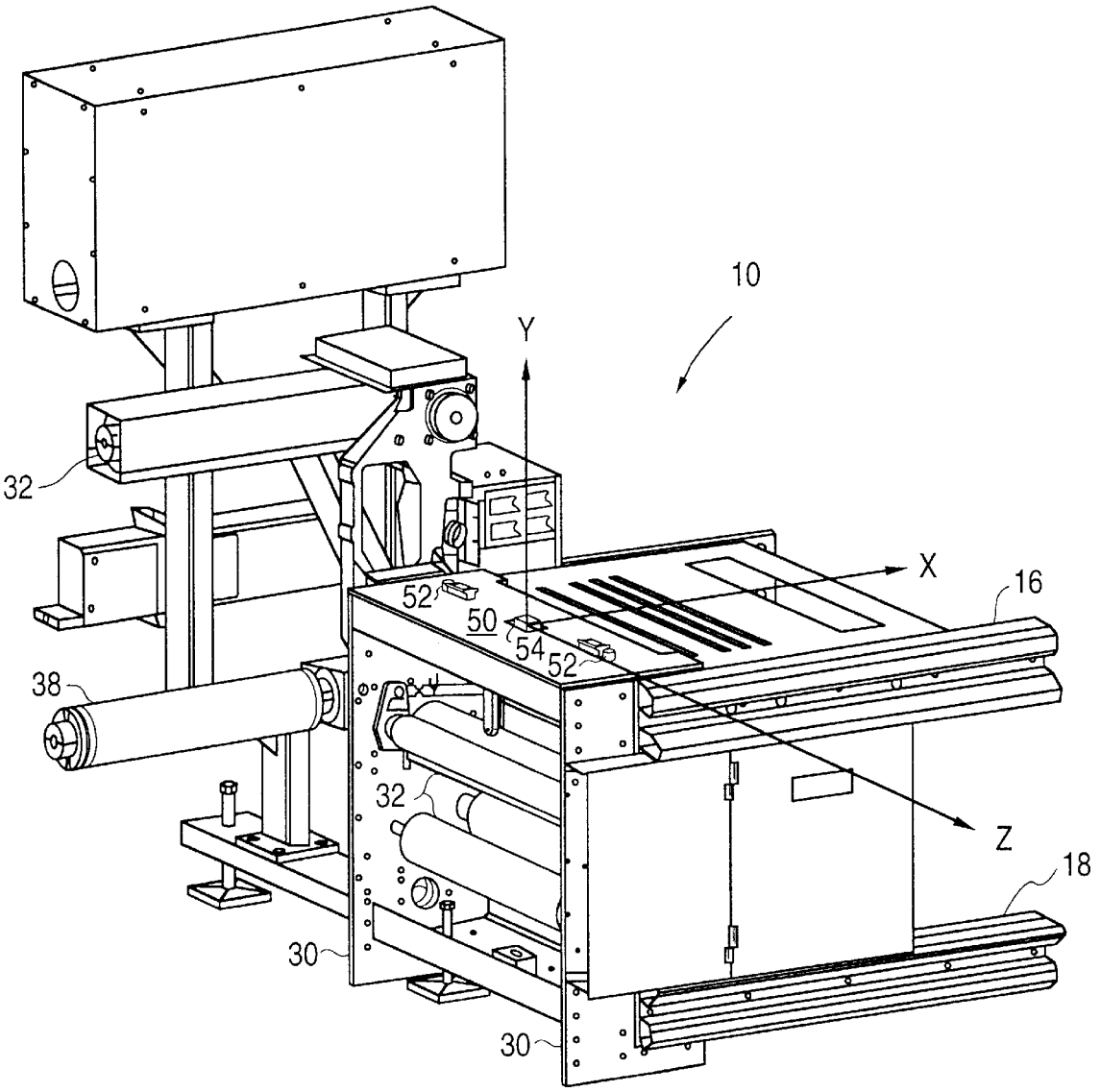
FIG. 4 is a perspective view of the embodiment shown in FIG. 3, but including rolls and other aspects of the embodiment.
Figure 5:
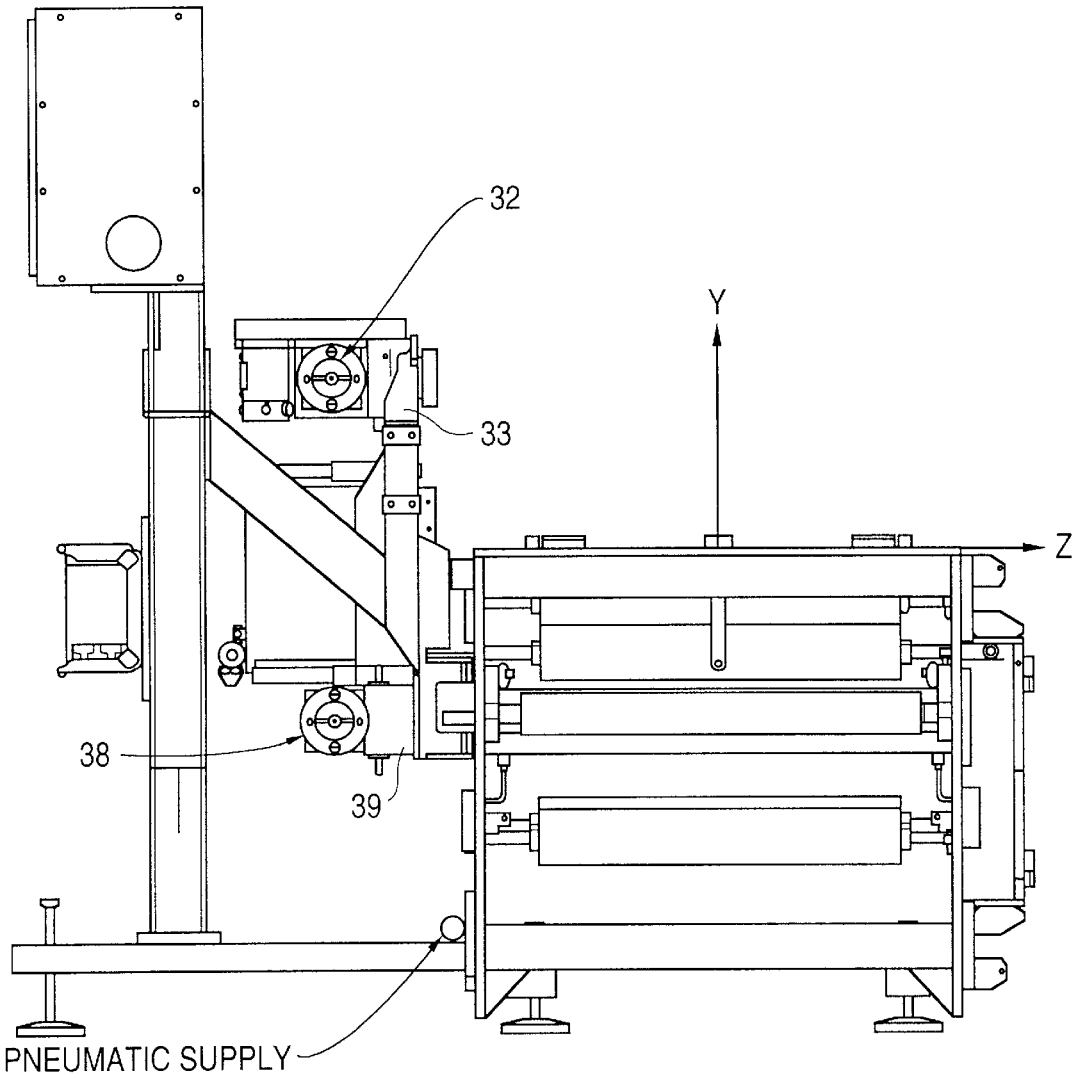
FIG. 5 is a view of one embodiment of the base module of the present invention.
Figure 6:
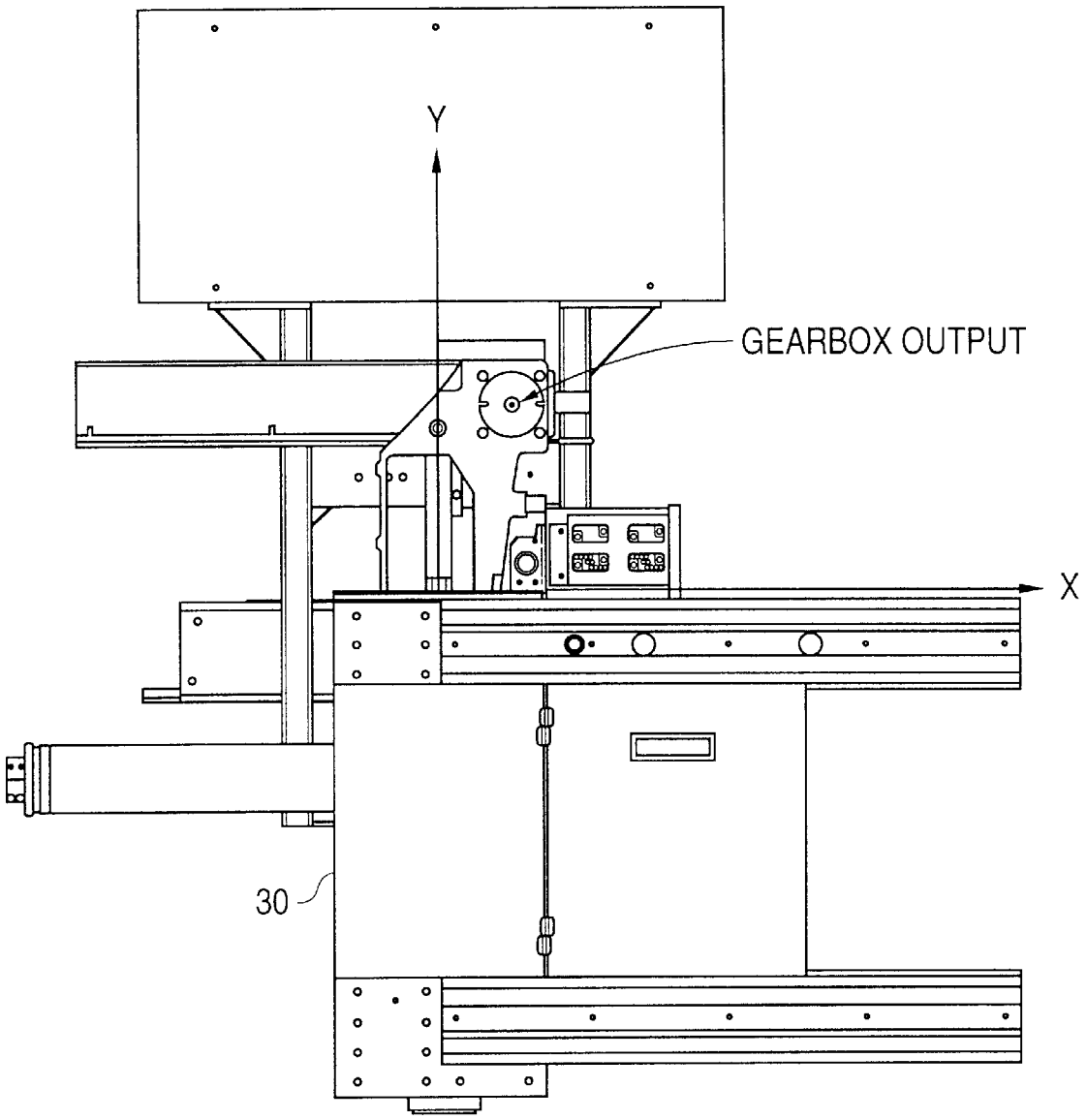
FIG. 6 is a different view of one embodiment of the base module of the present invention.
Figure 7:
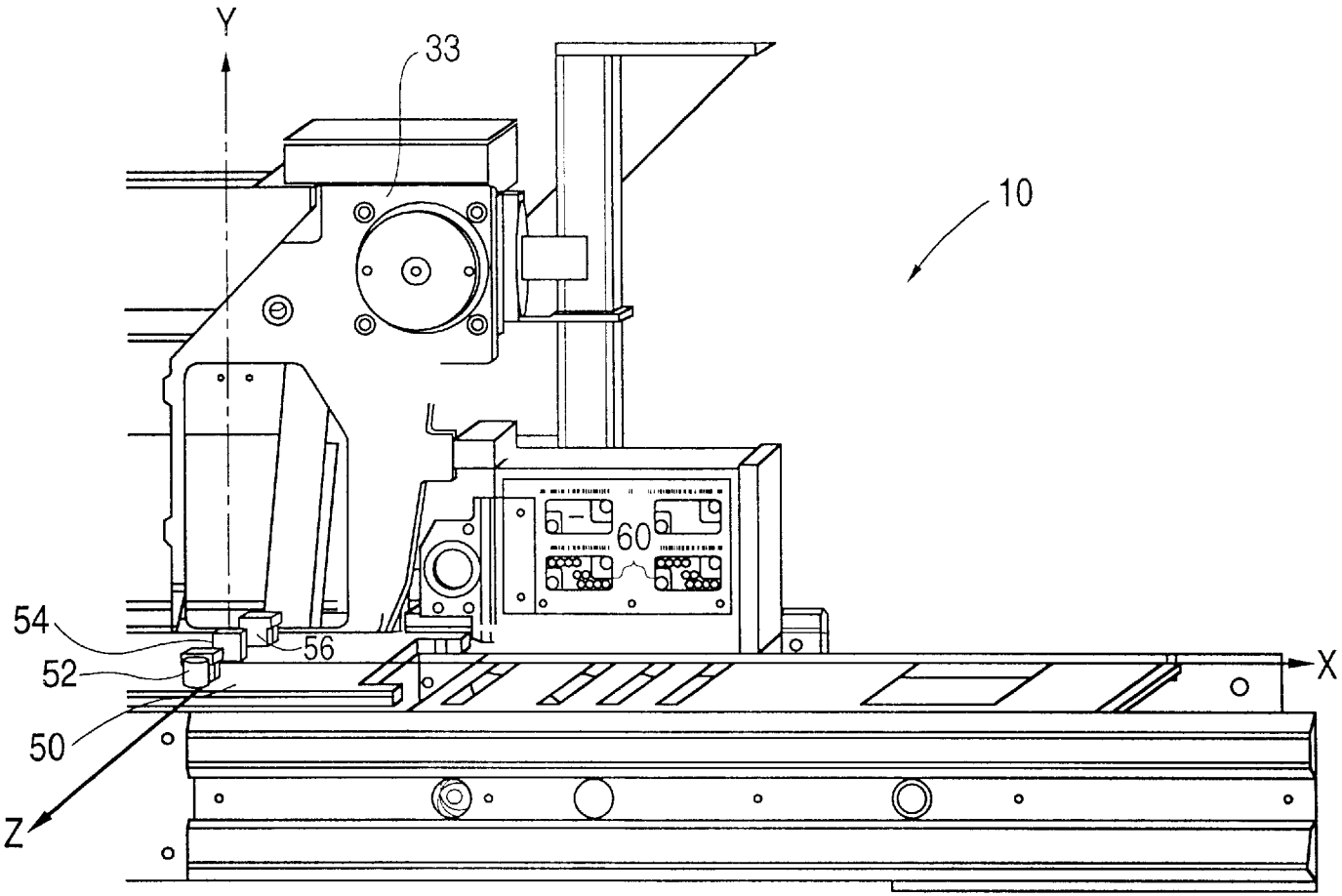
FIG. 7 is a perspective view of a portion of the base module of the present invention.

Referring to FIG. 3, the base module 10 is shown to comprise an external mating surface 50 with at least one alignment structure 52 disposed on the external surface 50. In the configuration shown in FIG. 3, the external surface 50 is shown as the top external surface for the base module 10. This external surface 50 is used as the mating and alignment surface for receiving a process head. Although it is preferred that this external surface used for mating and alignment be disposed on the top horizontal surface of the base module 10, it is clear that this external mating surface 50 could also be disposed on the side of the base module 10 or at some other convenient location on the base module 10.

As noted above, the external surface 50 includes at least one alignment structure 52 for aligning a process head 22 thereon. In the embodiment of the base module 10 shown in FIG. 3, two alignment pins 52 are shown protruding up from the external surface 50. The pins 52 may be round to permit grinding to a very accurate diameter. However, the present invention is not limited to this number of alignment structures 52. Clearly, any number of alignment structures could be utilized to perform the alignment and registry function. Likewise, the present invention is not limited to an alignment structure which protrudes outwardly from the external surface 50. In this regard, the alignment structure 52 could comprise one or more recesses disposed in the external surface 50 and designed to receive protruding pins from a surface of the process head 22. Moreover, the present invention also contemplates alignment via electrical or magnetic alignment structures.

The external mating surface may also include one or more structures 56 to prevent a process head from being lifted up from the external surface 50. In the embodiment shown in FIG. 3, two T-blocks 56 protrude up from the external surface 50 to ensure that removal of a process head is accomplished by sliding the process head laterally off the external surface 50 on to a cart.

Figure 10:
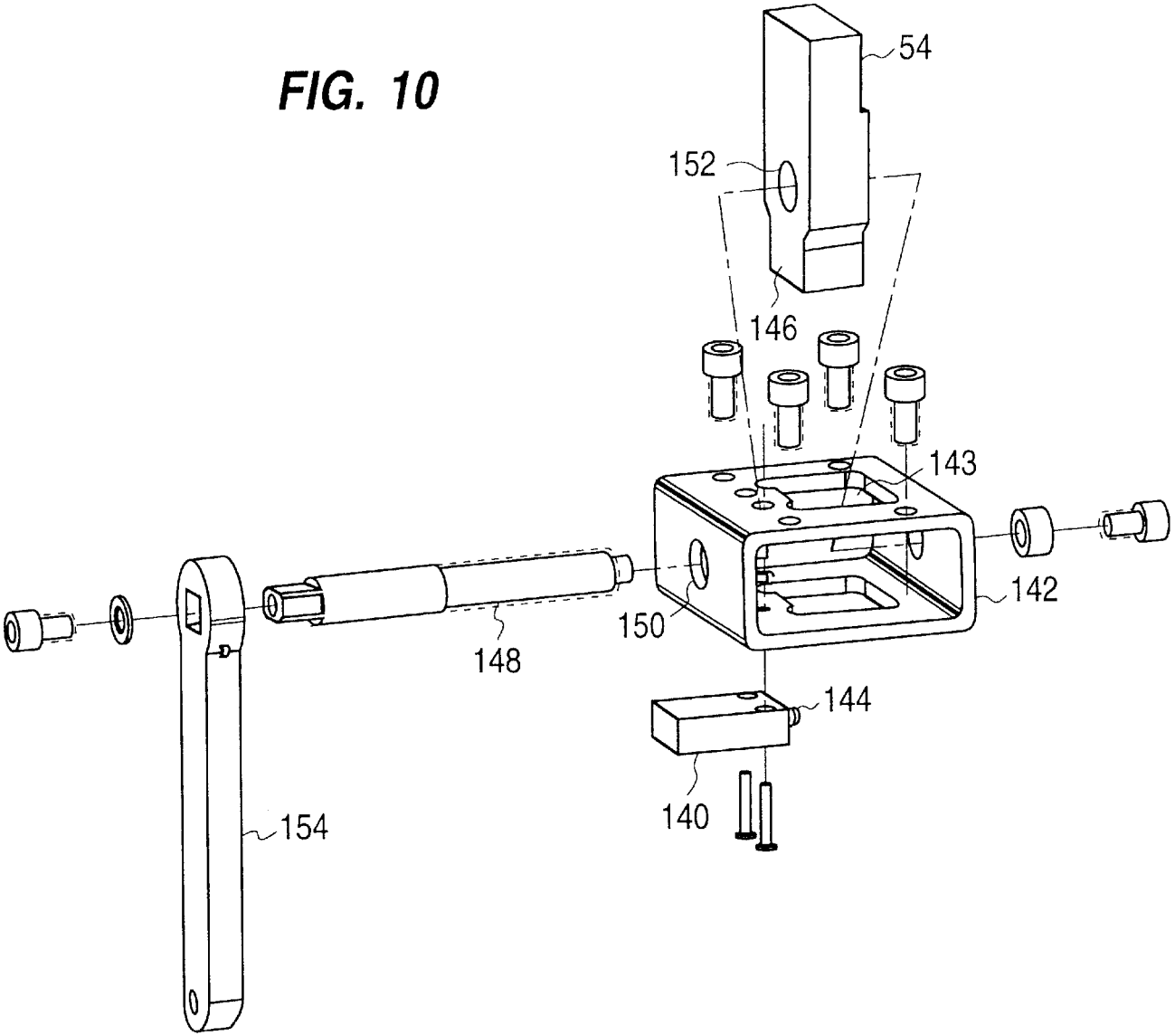
FIG. 10 an exploded view of an electrical switch structure and switch that may be utilized to implement the present invention.

The base module 10 further includes an electrical switch structure 54 for an electrical switch 70 (shown in FIG. 10). In the embodiment shown in FIG. 3, the electrical switch structure 54 is disposed on the external surface 50 and protrudes upwardly from the external surface 50. The electrical switch structure 54 is designed to switch the electrical switch 70 to provide the electrical power to electrical connectors 60 on the base module only when a portable process head (22–26) is disposed on the external surface 50 of the base module 10 and aligned and moved into registry with the alignment structure 52. Details for the electrical switch will be provided at a later point in this specification.

The base modules are formed by means of an external frame 30 with a plurality of rolls 31 disposed in the structure 30 to receive a web. See FIG. 4.

The web processor of the present invention further includes a process head drive 32 for driving a drive roll in each portable process head 22, 24 and 26. In the embodiment of the invention shown in the figures, the process head drive comprises a main drive shaft 32 for applying drive through an adjustable gear box 33 to a drive roll 34 (shown in FIG. 1) in each of the process heads. Note that the drive roll may be referred to variously as the impression roll in printing applications, and the base roll or anvil roll in die cutting applications, for example.

It should be understood that the process head drive may be implemented in a variety of other configurations. For example, the process head drive may be implemented by means of a plurality of servomotors, with a different one of the servomotors associated with each of the different base modules to apply a drive to the drive roll 34 in the portable process head in registry (mated) with that base module.

Figure 11:
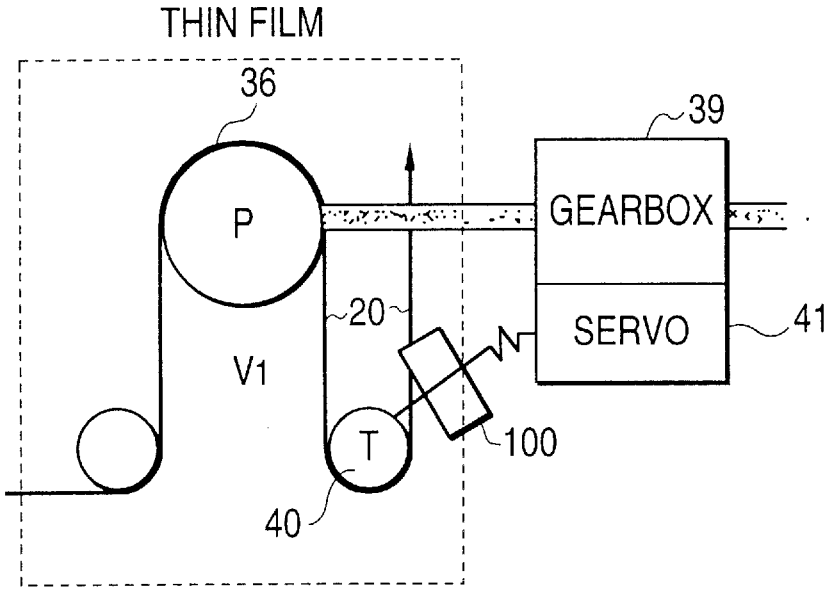
FIG. 11 is a schematic diagram of the pacing and transducer rolls and the gear box 39.

Each of the base modules 10–14 has a pacing roll 36 (shown in FIG. 1) associated therewith to adjust the pace of a web moving within the associated base module. Each of these pacing rolls 36 is driven initially at the same speed as the drive rolls 34. A servo 41, shown in FIG. 11, is associated with each pacing roll 36 to adjust the pace of the web moving over the pacing roll in accordance with a pacing control signal for that particular pacing roll 36.

In a preferred embodiment, each of the pacing rolls 36 is driven by a pacing drive shaft 38. The pacing drive shaft 38 applies its drive through an adjustable gear box 39, shown in FIG. 5, to the pacing roll 36.

In order to adjust the pacing of each pacing roll, the servo associated with each pacing roll is operatively connected to the gear box 39 associated with that pacing roll 36 to adjust the pace of the web. In one embodiment, this adjustment by servo 41 may be accomplished simply by changing the ratio of the output shaft to the input shaft by adjusting a planetary gear in a standard speed correction gear box 39 via a servomotor 41. This adjustment makes a phase correction to thereby change the output speed relative to the input speed. A speed correction gear box model SP2 by Tandler may be utilized to implement the present invention, by way of example. Note that a variety of other configurations could be utilized to control the gear associated with the respective pacing roll in order to accomplish the adjustment of the pace or phase of the web.

Note that when a main drive shaft 32 and a pacing drive shaft 38 are utilized, both of those drive shafts are operated by means of a single motor and are initially turning at the same speed.

Alternatively, a direct drive servomotor could be utilized in place of the pacing drive shaft 38 and the gear box 39 to thereby drive the pacing roll 36 and make adjustments to the pace of the web in accordance with a control signal. In such an embodiment, a direct drive servo motor would be disposed in association with each of the base modules 10, 12 and 14 in order to drive the pacing roll 36 thereat.

Note that the drive shafts 32 and 38 should preferably have a minimum torsional stiffness as follows: for a press width of 7/10", the main drive shaft 32 should have a minimum torsional stiffness of 1.94E5 and the pacing drive shaft 38 should have a minimal torsional stiffness of 9.34E4. For a press width of 13/16", the main drive shaft 32 should have a minimal torsional stiffness of 2.51E5 and the pacing drive shaft 38 should have a minimum torsional stiffness of 9.34E4. Finally, for a press width of 20/24", the main drive shaft 32 should have a minimum torsional stiffness of 3.35E5 and the pacing drive shaft 38 should have a minimal torsional stiffness of 9.34E4. Preferably, also the allowable unbalance force in any line shaft section should not exceed 1.5 pounds force at 1,360 RPM.

It should be noted that in the embodiment shown in the figures, the gear box output shaft diameter for the gear box 33 is 22 mm and the output shaft length is 35 mm. The gear box output shaft drive may include a 106 tooth, 26 DP 20° pressure angle helical gear, also known as the main drive gear. The gear may be approximately 1" wide with approximately a 14° left-hand helix angle. The gear teeth may be beveled to accept the mating gear as it is slid into engagement from the operator side toward the gear side.

For this configuration, the process head drive gear that mates with the main drive gear should be a 106-tooth, 26 DP, 20° pressure angle helical gear. The gear may be approximately 0.9" wide with a 14° right-hand helix angle with a crown. The gear teeth for this process head drive gear may be beveled to mate with the main drive gear as the process head drive gear is slid into engagement.

Each base module further includes a transducer 40 associated therewith and disposed to monitor a characteristic of the web 20 at the associated base module and to generate a transducer signal in accordance therewith. In the embodiment shown in the figures, and particularly FIG. 11, a transducer role 40 is disposed to carry the web 20 and to measure the tension therein. This measuring of the tension in the web may be accomplished, by way of example, by measuring the deflection of the transducer roll 40 as the web 20 is moving therearound. A signal representative of this characteristic of the web at the associated base module may be applied, in one embodiment, to a control module 100 (shown in FIG. 12) for application to servo 41.

Referring to FIG. 12, the control module 100 receives on lines 102 and 104 transducer signals from transducers on the transducer roll 40 and operates to generate a pacing control signal to adjust the pacing of the web at the base module. A variety of different transducer types may be utilized to implement the present invention including tension transducers.

The pacing daughter board 100 may receive a first transducer signal on the line 102 which provides a front tension signal from a front transducer, and a tension signal on the line 104 which represents a rear tension signal from a rear transducer in the configuration. The daughter board 100 provides signals on lines 106 and 108 to set the pressure of a nip roll against the pacing roll. The pacing daughter board 100 may also provide a signal on line 110 to turn the power on and off for a servo drive 112.

The pacing daughter board 100 controls the servo drive 112 via a start line 114, a servo enable line 116 and an RS 232 line which provides a communication link between the pacing daughter board 100 and the servo drive 112.

The pacing daughter board 100 also receives on line 120 an encoder signal from a count daughter board or from a previous base module which is indicative of the speed setting for the pacing drive. By way of example, this encoder signal may simply comprise a square wave signal with the frequency of the square wave being indicative of the speed of the pacing drive. This encoder signal is applied on line 120 to the pacing daughter board 100 where it is buffered via an amplifier 122. The buffered encoder signal is then applied via the line 118 to the servo drive 112.

The servo drive 112 controls a servo motor 130 via the drive signal lines 132. A resolver feedback signal indicating the position and speed of the servo motor 130 is provided via the line 134 back to the servo drive 112.

The pacing daughter board 100 further receives various voltage signals and emergency stop signals and zone guard signals.

Accordingly, the pacing daughter board 100 may be utilized in one embodiment to adjust the pacing set via the encoder signal on line 120 in accordance with the signals from the tension transducers 102 and 104.

In a preferred embodiment, the control module further includes a pacing common node which provides communication to other base modules and to a master control module. This pacing common node may be implemented by a local operating network chip that may be connected into a local operating network bus. A variety of different local operating network systems are available that may be utilized to implement the present invention. By way of example, but not by way of limitation, a local operating network chip designed by Echelon Corporation may be utilized to implement the pacing common node. For example, each node in the present system may be implemented utilizing a member of the Neuron chip family. The Neuron® 3120 chip incorporates on-board RAM, ROM, and EEPROM memory. The Neuron® 3150 has RAM and EEPROM on-chip and provides an external memory interface. Both of these chips have eleven by-directional I/O pins for interface to applications hardware, flexible timer/counter hardware and a 48-bit serial number permanently programmed into every device. Incorporated in each of the Neuron chips is firmware that implements a full LONTALK communications protocol and handles all of the details of task scheduling, I/O management, network management, communications, and housekeeping.

A pacing common node is shown in FIG. 12 as block 122. As noted above, this pacing common node may be implemented by a local operating network chip. The pacing common node block 122 communicates with a local operating network bus via a base distribution board 130. This board 130 is a standard circuit for distributing communications to a bus network. The distributed control communications are provided on line 124 between the pacing common node block 122 and the base distribution board 130. As can be seen from FIG. 12, the base distribution board 130 provides a VAC signal, distributed control communications, an emergency stop, ID, and guard signals to each of the nodes connected to the local operating network.

The pacing common node block receives a station 6 bit ID from the adjacent base module and communicates its own 6 bit ID to the other pacing common node blocks in the system via line 126. A press control interface signal is applied on line 128 to the pacing common node block 122. This is the control line that is part of an Echelon control bus used to communicate with the pacing daughter board. Control communication is provided on line 132 between the pacing common node block 122 and the pacing daughter board 100. Various other signals including a VDC signal, a common signal and a RESET signal are applied from the pacing common node block 122 to the pacing daughter board 100. Finally, the pacing daughter board 100 provides a 5 bit ID signal identifying the pacing daughter board to the pacing common node 122.

In a preferred embodiment, a main control module (not shown) is connected to communicate with the local operating system bus, so that control of each of the base modules can be effected from a single main control terminal. The main control module may be implemented, by way of example, by a Dynapro System Computer, Model no. 3010. The pacing and the gain at each of the base modules may be set at the main control module.

Additionally, the main control module is, in a preferred embodiment, designed to receive the ID signals from the various pacing daughter boards along with a signal from each of the pacing daughter boards identifying what other of the system functional control modules that the pacing daughter board must communicate with in order to properly function. Likewise, the main control module may receive an ID signal from each of the other nodes in the system along with a signal from each of these other nodes or functional control modules identifying what other of the functional control modules that the node must communicate with in order to properly operate.

The main control module may then generate an indication of whether an overall system resulting from the mating of the various process heads on the base modules is functional. For example, if a particular node or functional control module requires a configuration including a dryer functional control module, then its signal will indicate that functional control module must communicate with a dryer functional control module. If a dryer has been removed from that base module, then there will be no dryer functional control module to receive the communication from the particular other functional control module and an indication will be generated at the main control module. By way of example, this indication may be implemented by means of a screen with a diagram of the overall system showing an indication of each functional control module and its interrelationship with other function control modules that it must communicate with, and further providing an indication via a message or symbol on the screen to show the operator that there is a problem because one of the required functional control modules is missing.

Figure 13A:
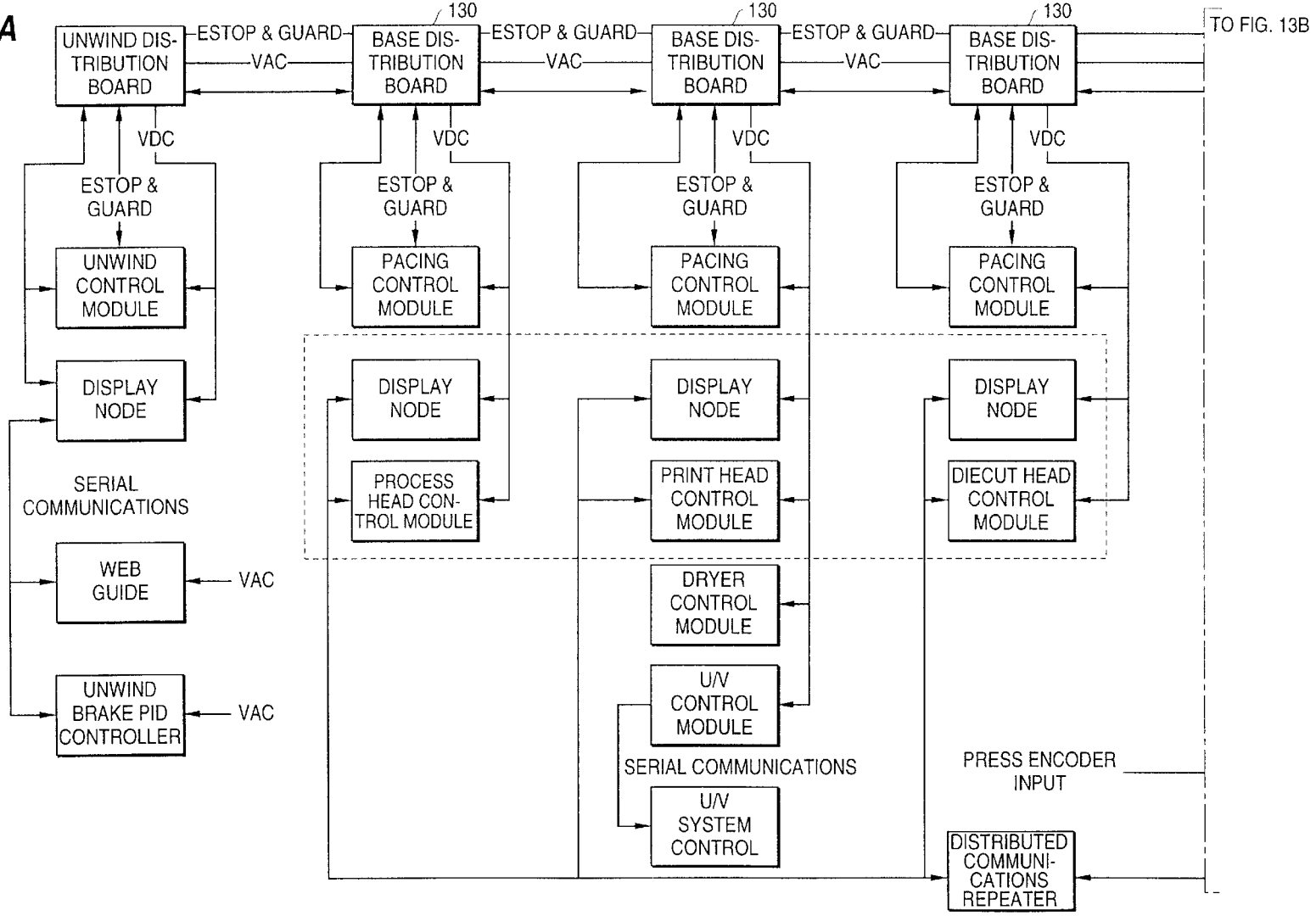
FIG. 13 is a schematic block diagram of a preferred embodiment of functional control modules in the system.
Figure 13B:
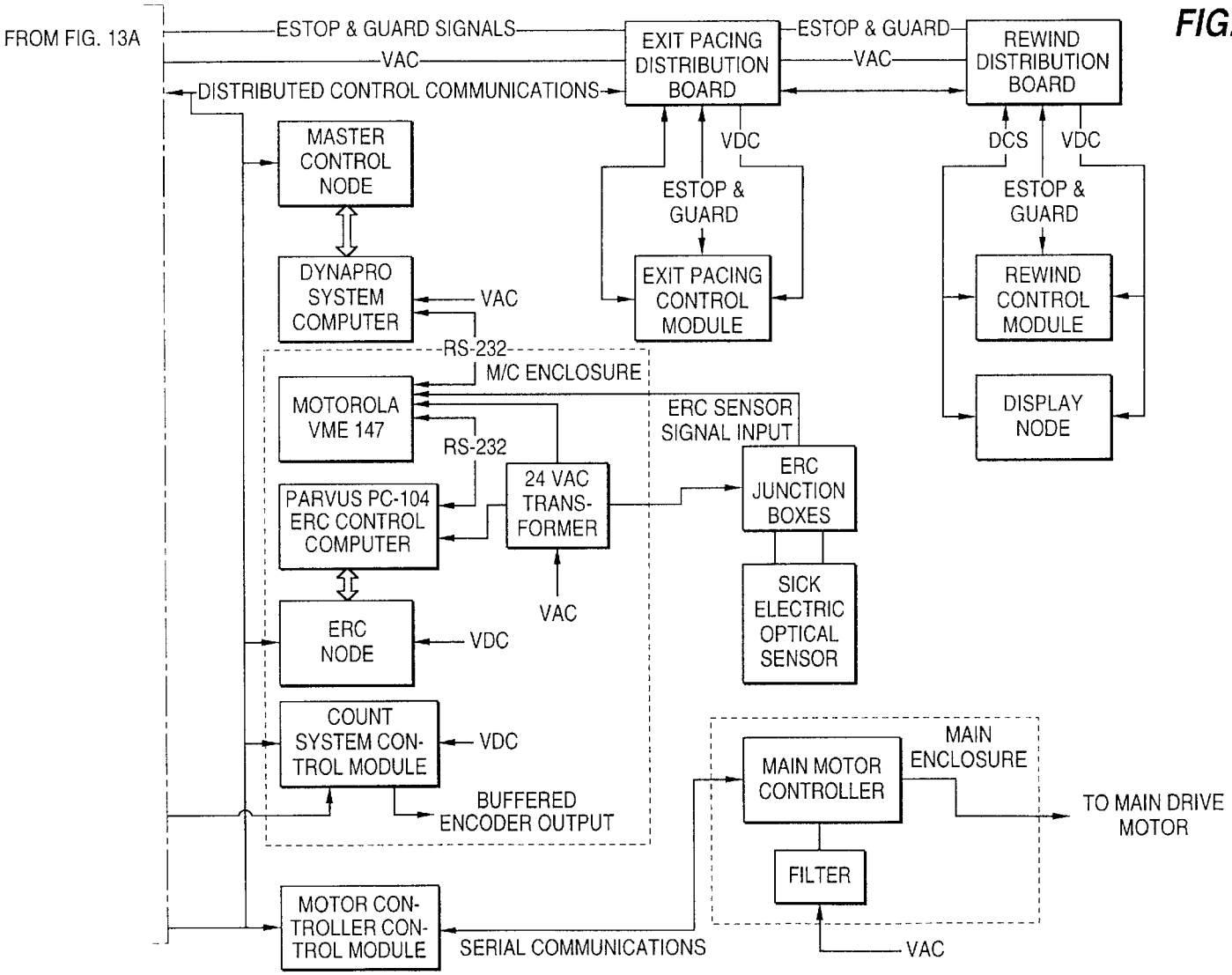

FIG. 13 illustrates a preferred embodiment of functional control modules (nodes) that send an ID signal and a signal indicating which other functional control modules it is required to communicate with.

To accomplish the foregoing, the apparatus of the present invention utilizes a method of "binding", or connecting functional control modules or nodes to one another in order to share distributed information within the web processing apparatus. Such information typically includes press speed, tension values, and press run status. The binding process is particularly useful because of the present modular design which allows for numerous configurations to suit any production need.

Binding typically requires three tables to be written within a controller such as a Neuron chip based on the current configuration of base modules and process heads. Some of the information to write to these tables is known before the press is powered-up, while other information can only be obtained after the current configuration is determined at power-up. The domain, network variable configuration, and address tables comprise the three binding tables for this embodiment.

The domain table contains information about a functional control module's or node's location or address. The domain table is analogous to a "home address" of an envelope. When a message is sent out on the network, the module checks the messages' destination address with its domain table. If this message is intended for this particular module or node, it is accepted, otherwise it is discarded. When a message is sent from this module, the domain information is packaged into the "return address". During the binding process, the domain table information can be written at power-up. At power-up, the module reads information from its input ports located on that particular module. The domain table's module (node) number is written directly from one of the input ports. The domain table's subnet (either the particular base station number or the control stop press number) is written either by a second input port or hard-coded if the module is either the motor controller module, count system module, electronic registry control module, or master control. All other domain table information is set to a pre-power-up default state.

The network variable configuration table contains information about the variables sent over the network. The network variable configuration table is analogous to the address of an envelope. When a message is sent or received, the network variable configuration table determines which variable will send/receive the message. The information for this entire table is known before the power is applied, and does not typically change with the configuration. The table for each module consists of information about the variables to be used by this module, such as: direction of the variable (in or out), synchronization, and selector number (variable's identification).

The address table contains information about the address of a particular module on the network or a group of modules on the network. The address table is analogous to a rolodex of home addresses. When a message is sent, the address table is referenced to send the variable in the message to the correct receiving module or node or group. This table is dependent on press configuration. Groups of modules (nodes) change as the press configuration changes. Accordingly, the binding function must query the press to determine how this table is to be written for every module on the press.

The binding process includes the steps of determining the press configuration, writing all of the tables, ensuring that the press stations match a known configuration, and detecting any modules or nodes that are unable to communicate on the network. The binding process created typically is initiated in one of two ways: a motor controller initiates binding or an LCD display initiates binding. The motor controller binding is a press-wide binding, while the LCD display binding only binds modules at its station. The motor controller binding must be used when a new press configuration occurs i.e., removing or adding a station. Either the motor controller or the LCD display binding can be used if module is being replaced within a station.

When a binding session starts, the domain table information is read from local input switches and is written into the domain table. This process of writing the domain table is common to every module (node) on the press. Next, a "check-in" process occurs where every module (node) on the press sends a message to the master module (node) of the press/station where it resides. The master module (node) for a given press/station is typically the display module. However, for the count system module, or electronic registry control module or the master control module, or the display modules for the various stations, the motor controller is the master module (node) which will be receiving the check-in messages from these modules. The check-in binding process collects variables only for module (nodes) and groups that are currently installed. Therefore, all messages sent over the network will be received by an installed module.

Once check-in is complete, each master module will write its own address table and the address table entries for all modules subordinate to this module. During this process, all errors encountered are recorded, but not acted upon until the end of binding.

Once the address table entries are written for each module, then each master module will check the validity of the installed configuration of the press and report errors to the motor controller. The motor controller module will then determine if the binding was successful or unsuccessful and send a message to all modules in the press as to the result of the binding. If binding was successful, the modules will begin running their applications. If binding was not successful, then an error condition will appear on several displays to help trouble-shoot the problem.

During the binding process, it is possible that a module may have been isolated from the network and have been unable to process the binding messages. This module will not be bound to the system and must not be allowed to remain powered-up on the running press. To prevent this isolated module from remaining powered-up, the module will open an E-STOP chain and disable the press from starting if a binding complete message is not received by the module within a predetermined period of time from power-up.

Figure 14:
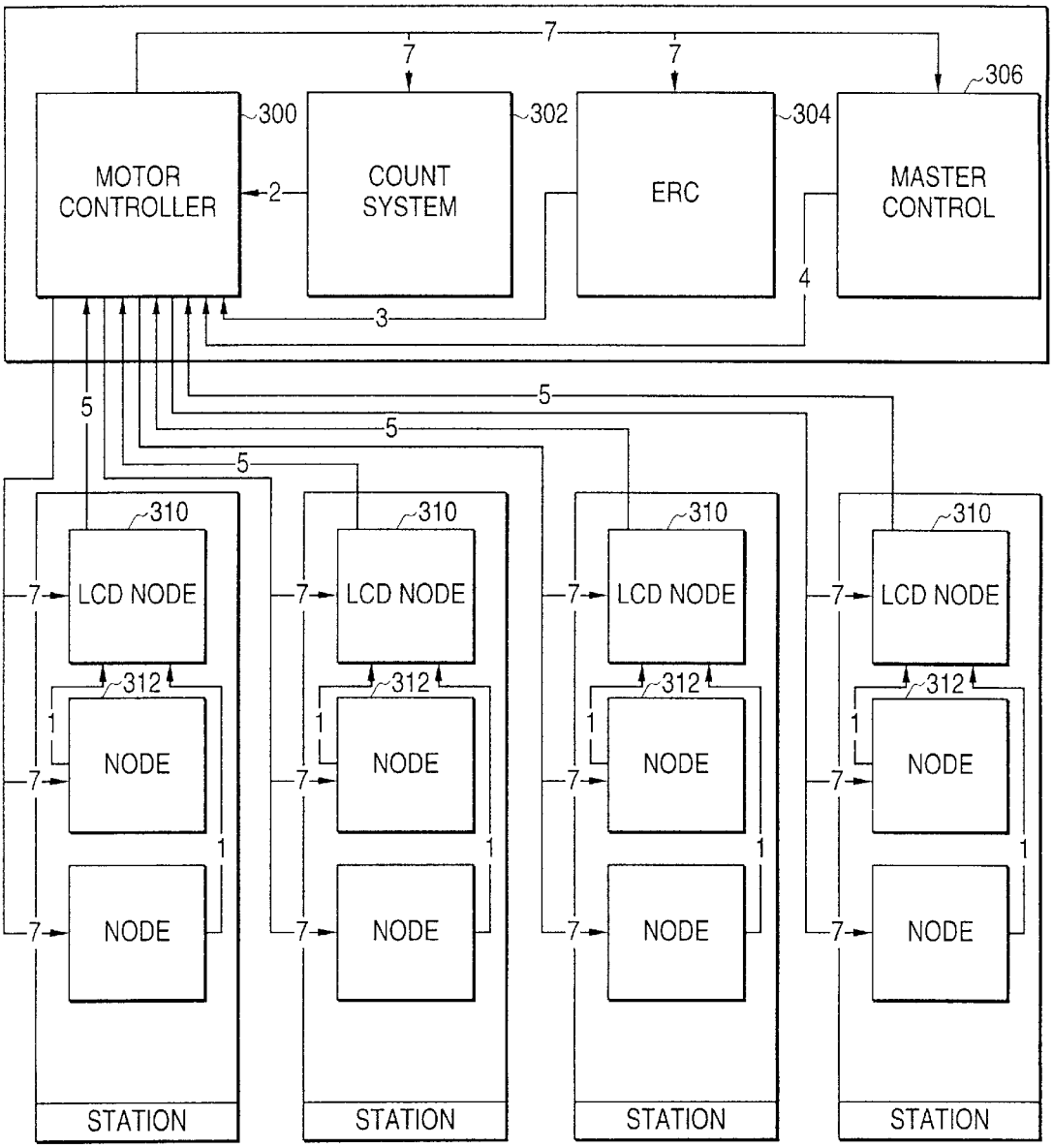
FIG. 14 is a block diagram of a module/node binding configuration.

FIG. 14 is a block diagram of a module/node binding configuration. The figure shows a block for the motor controller module 300, a count system module 302, an electronic registry control module 304, and a master control module 306 which comprises the press control station. Each of the stations includes a master module or node which may, in one embodiment, be the display node 310 for each of the stations. Each of the stations will then have at least one sub-module 312 which will report to and bind with the master module 310 for that particular station.

Figure 15A:
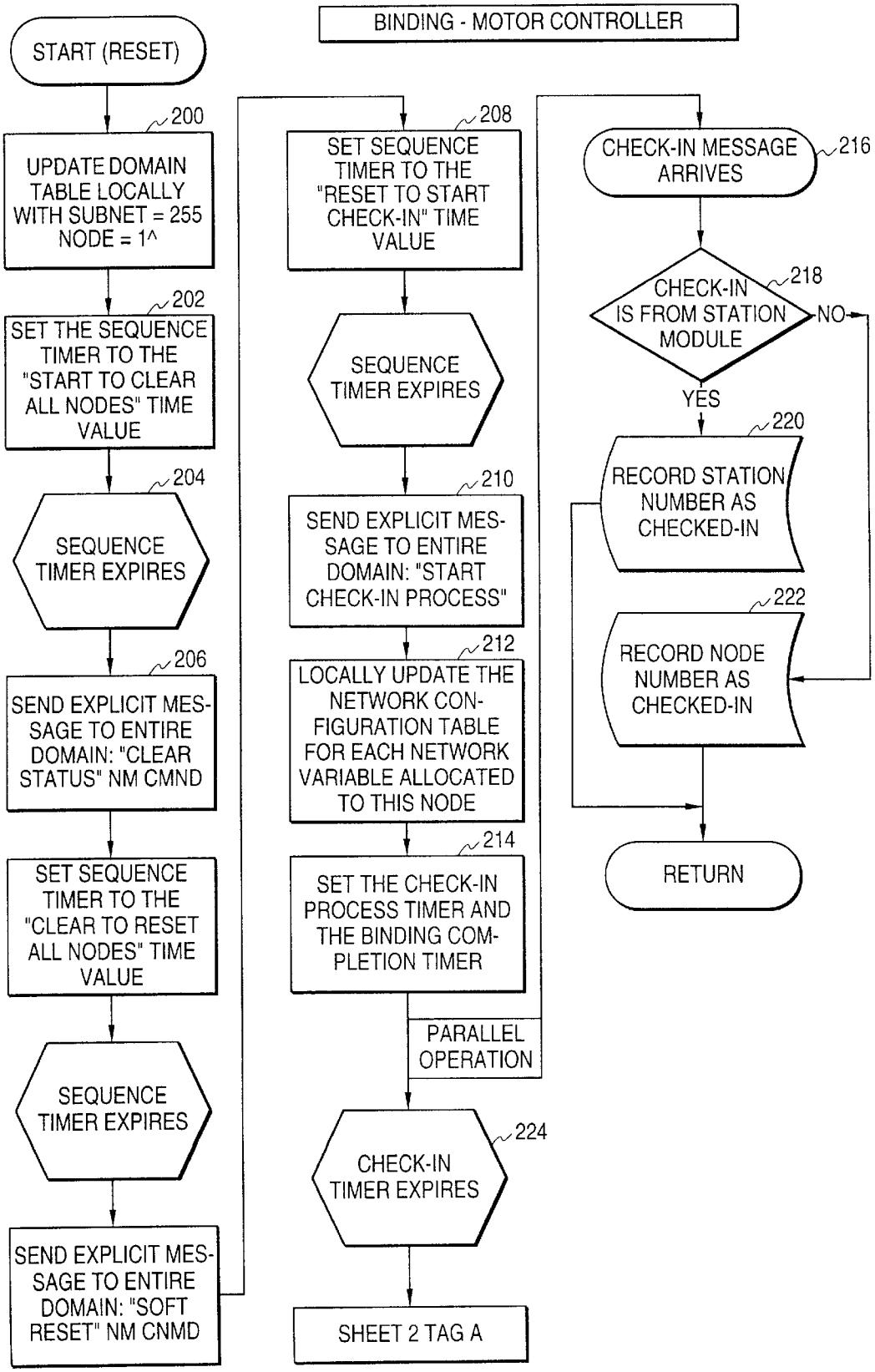
FIGS. 15A, 15B, and 15C comprise a block diagram of a flowchart for a software program that may be utilized to implement motor controller binding for the present invention.
Figure 15B:
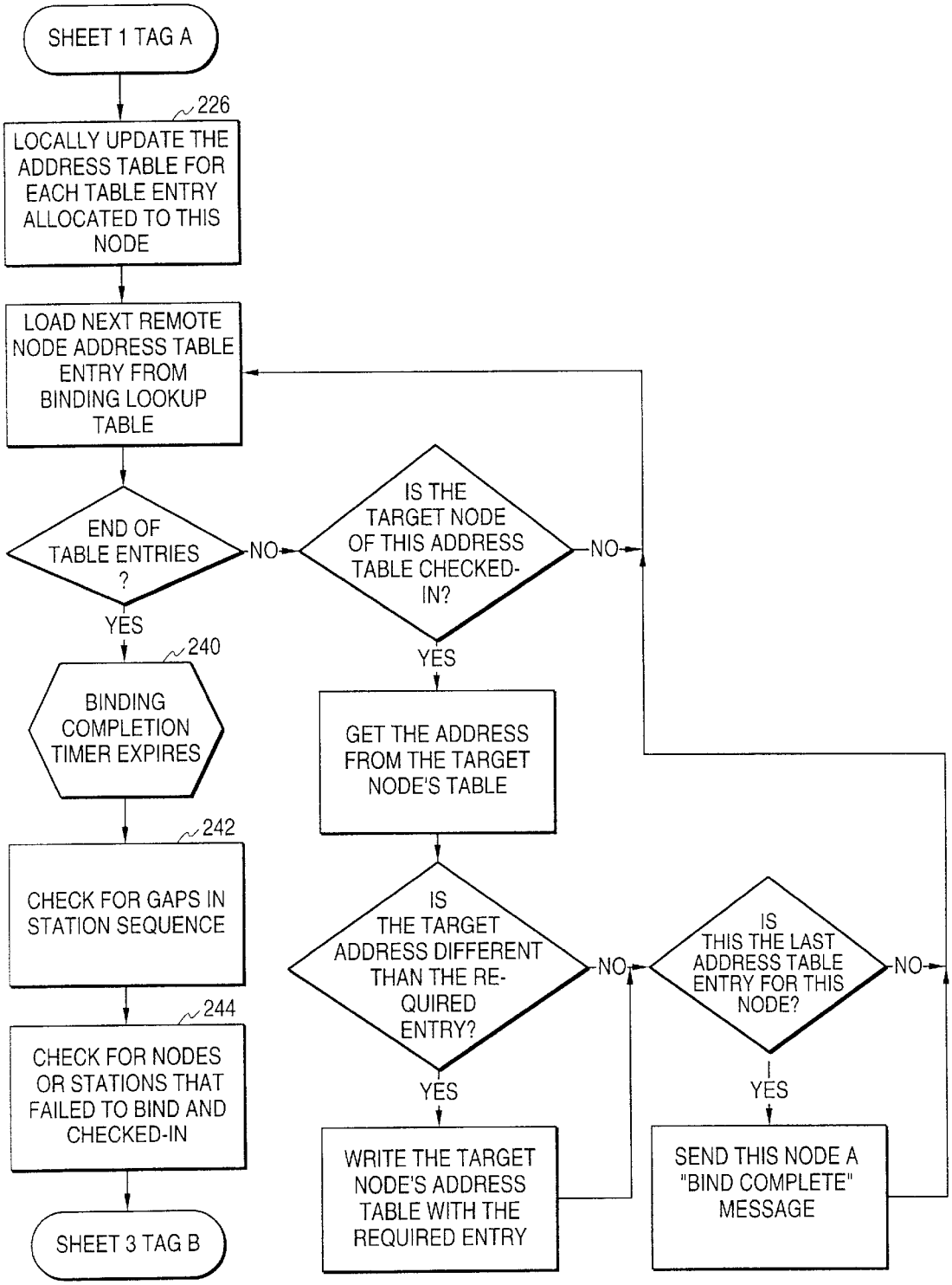
Figure 15C:
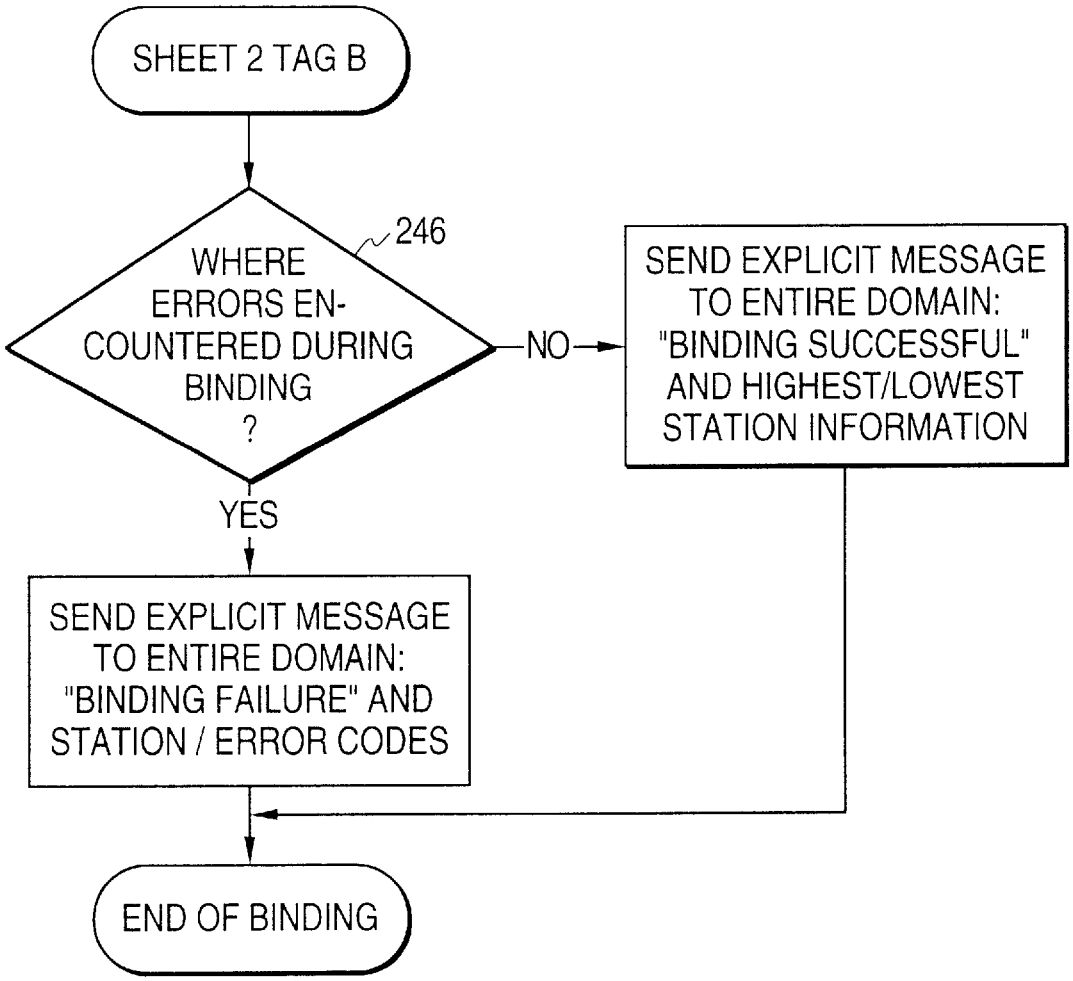

A variety of different software programs may be utilized in order to perform a binding operation. FIGS. 15A, 15B, and 15C comprise a flowchart of one such program that may be utilized in order to perform this monitoring and binding function. In this configuration, the motor controller would act as the main binding center or agent. The program of FIGS. 15A, 15B and 15C allows a quick determination of whether a configuration of the printing press or web processing apparatus is functional, thereby permitting a very fast reconfiguration of such an apparatus. As noted above, one of the functions of the program is to write a domain table comprising a list of home addresses for each functional control module or node, and a communication address table listing the addresses of functional modules that a particular functional module will need to communicate with, and a network variable configuration table which indicates what variables at a particular module address that a given message is directed to. This flowchart software may be conveniently utilized either within the main control computer or a motor controller for the main drive.

Referring now to the flowchart of FIG. 15A, the domain table is updated in block 200. Note that in this configuration, subnet 255 includes the electronic registry control that monitors an adjust registry for the web, the control module for the count system that counts printed images on the web and keeps track of the amount of footage running through the system and provides various timing signals, and the master control computer. In the next block 202, a sequence timer is set to start to clear all of the internal status registers in the various functional control modules (nodes). The sequence timer expires in block 204 and then an explicit message is sent to clear the entire domain in block 206.

Various additional set and reset and message blocks follow. In block 210 an explicit message is sent to every functional control module (node) requiring that that module check in with the motor controller. In the next block 212, the network configuration table is locally updated for each network variable allocated to this module. These variables include the press speed, press status, zone status, tension, etc.

In block 214, a check-in process timer is set thereby providing a predetermined period of time during which all of the functional control modules must check in with the motor controller.

As check-in messages arrive at block 216, it is determined in decision block 218 whether the check-in message is from a station module (the display module for a given base), or is a check-in message from either the count system module, the electronic registry control module, or the master controller. Block 220 records station or display module check-in messages. Block 222 records check-in messages from the count system module, the electronic registry control module and the master controller. When the check-in timer expires in block 224, the address table for each table entry allocated to this particular functional control module is locally updated in block 226 in FIG. 15B. This means that the motor controller software is writing into the table a listing of what other functional control modules the particular functional control module will communicate with.

At the end of this check-in process, the binding completion timer expires in block 240. The following block 242 then checks for gaps in the base station sequence. In essence, the system knows that each numbered base station must check in with no gaps in this numbered sequence. This process further includes block 244 wherein it is determined whether specific nodes such as the count module node, or the electronic registry control module, and the various base stations have failed to bind and check-in and also searches for error messages and invalid station configurations. In this regard, the display modules for each of the different base stations will send an error message if an essential node within that base station has not properly checked-in to the display module for that station. Accordingly, although the display module for the particular base station may have checked-in with the motor controller, the display module will send an error message to the motor controller software and will send an E-STOP message to the entire system to shut down the system. This E-STOP message is sent via a 24 VDC wire that is daisy-chained between the different base stations. Block 246 is a decision block which determines whether any errors were encountered during binding, including gaps or missing base station check-in messages or E-STOP messages from individual display modules from particular base stations. If no errors were encountered during binding, then a message is sent to the entire system and provided on a display at the master control that binding has been successful. Alternatively, if errors were encountered during the binding process, then a message is sent to the entire system. The software may be written to indicate that there has been a binding failure, identifying base station gaps, and may further be designed to detect particular functional control modules that are missing and what type of error was detected including that the configuration is not proper, and may further be designed to indicate which stations, if any, are missing or don't fit the configuration. This information may be displayed as a written message on a display and/or by means of icons representing the overall configuration of the system. Additionally, this information may be displayed at the individual display modules for the various base stations in the system.

Figure 16A:
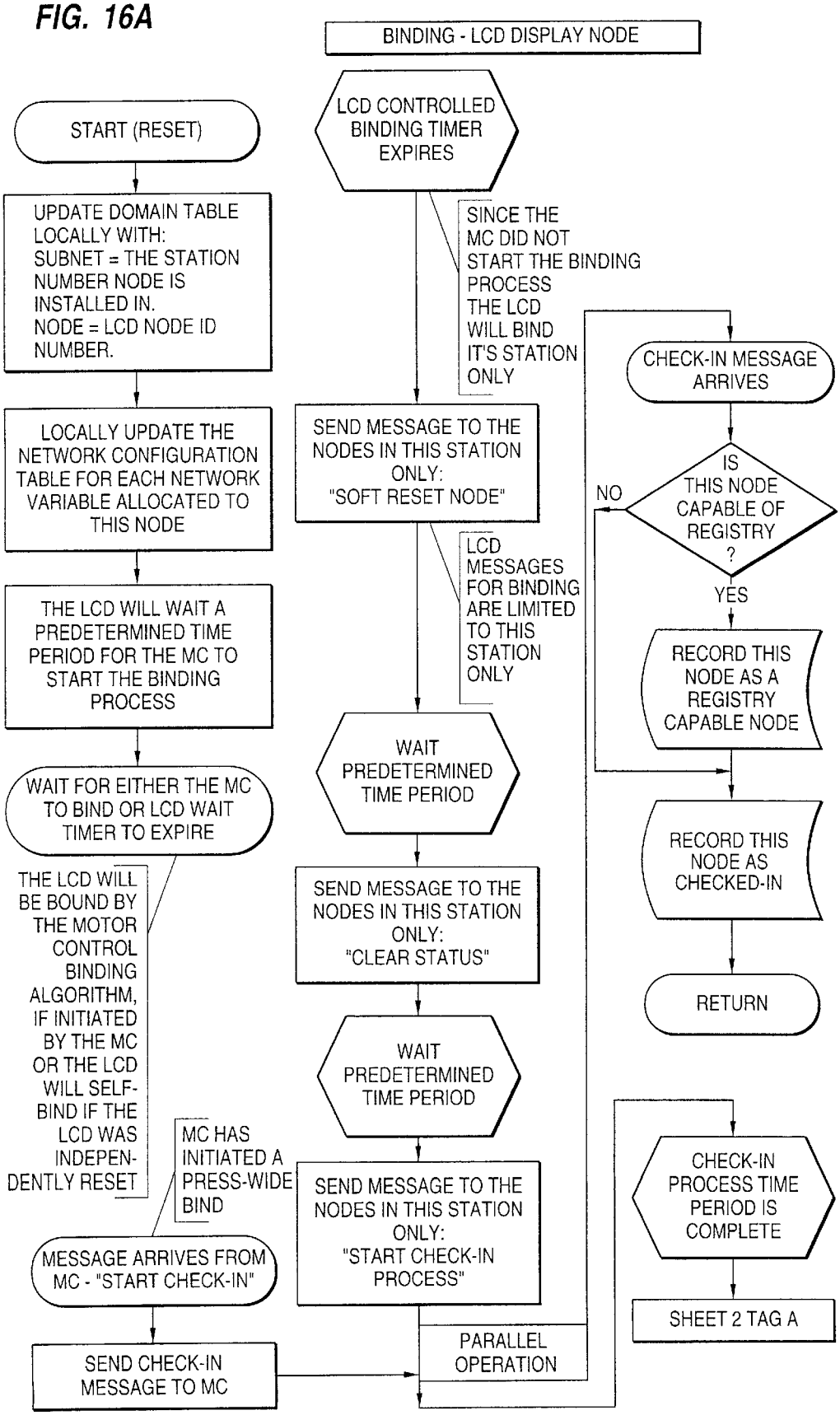
FIGS. 16A, 16B, and 16C comprise a block of a flowchart for a software program that may be utilized to implement display module/node binding for the present invention.
Figure 16B:
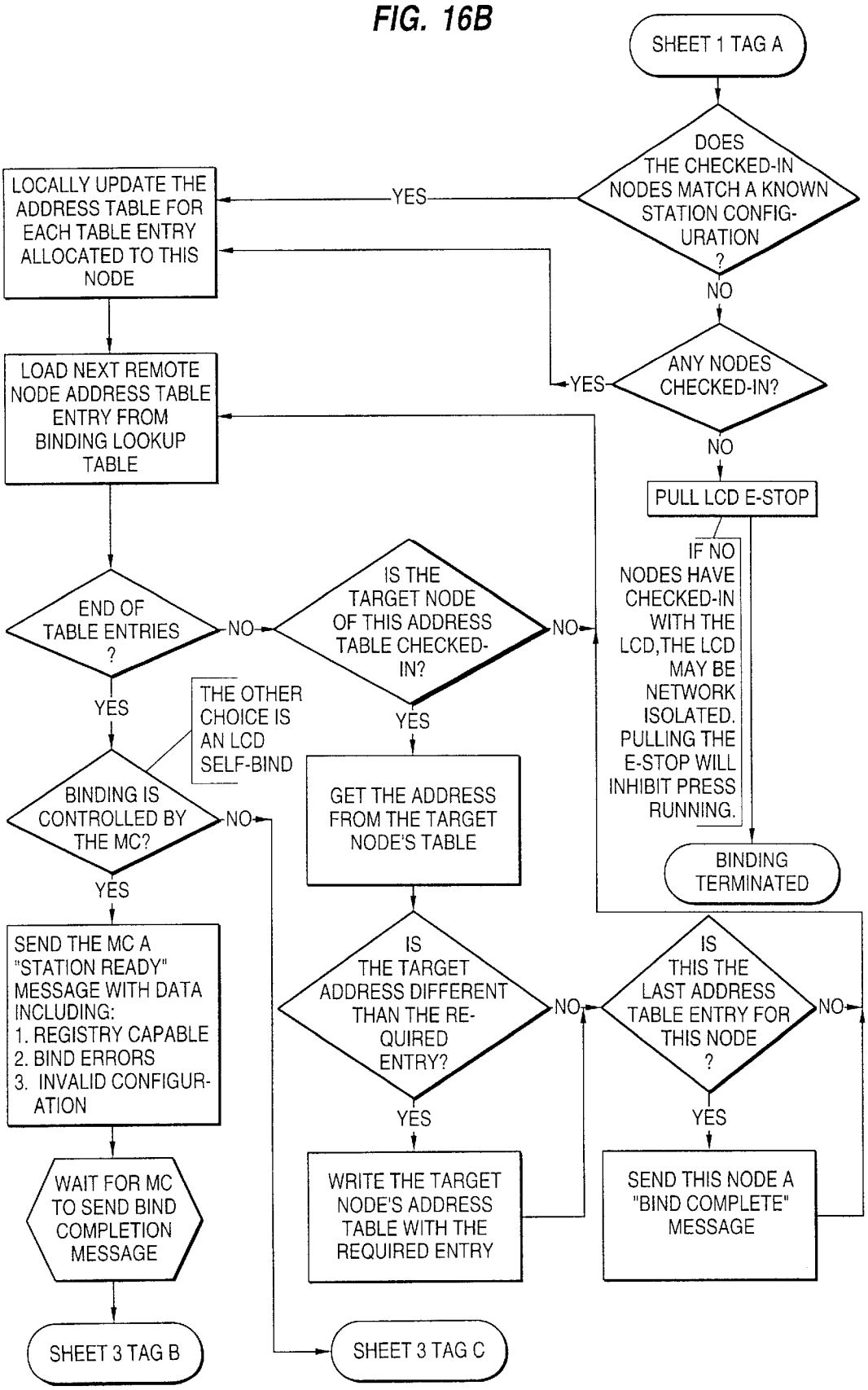
Figure 16C:
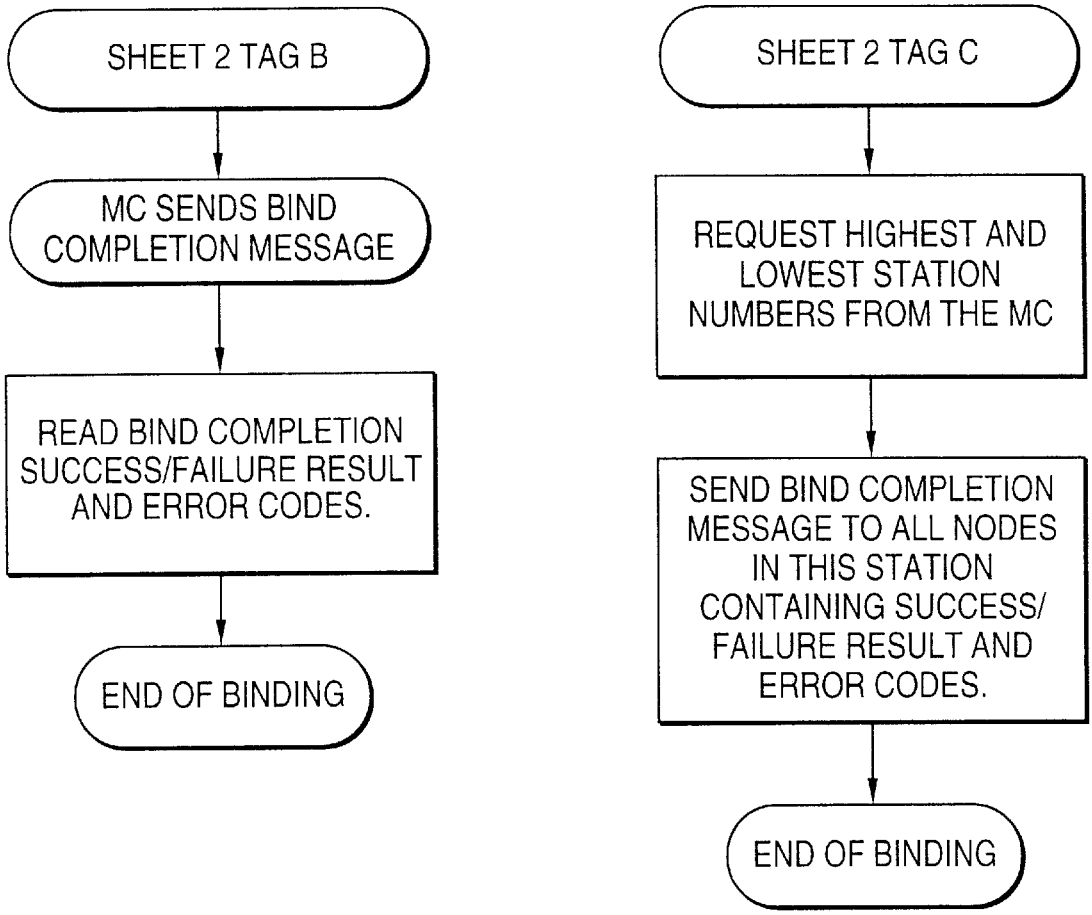

FIGS. 16A, 16B and 16C comprise a block diagram of a flowchart for a software program that may be utilized to implement display module/node binding for the present invention. The functional logic is self evident from this flowchart and is designed to function with the flowchart of FIG. 15.

Figure 17:
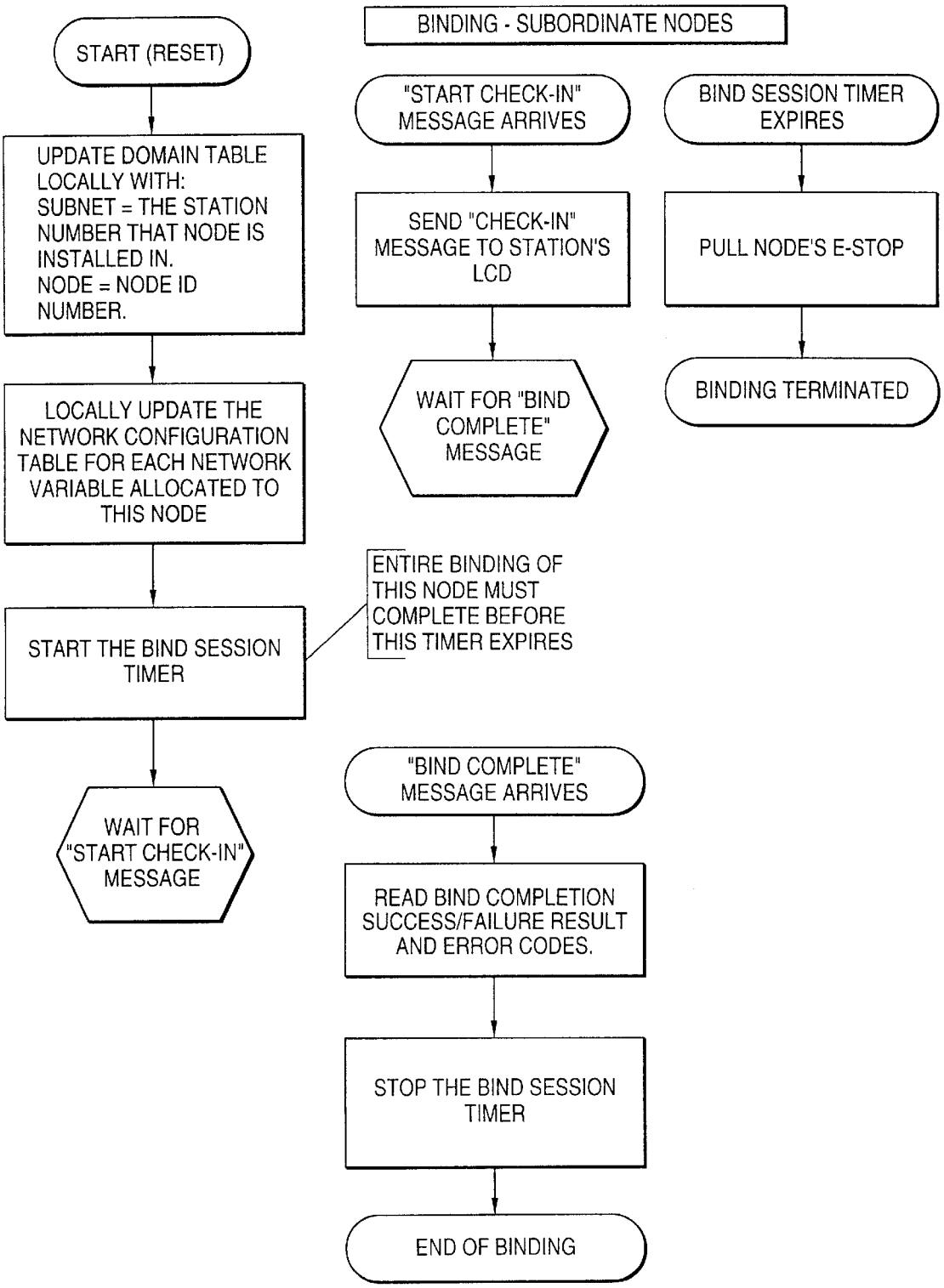
FIG. 17 is a block diagram of a flowchart for a software program that may be utilized for binding subordinate modules/nodes for the present invention.

FIG. 17 is a block diagram of a flowchart for a software program that may be utilized for binding subordinate modules/nodes for the present invention. This flowchart is again designed to function with the flowcharts of FIG. 15 and FIG. 16.

It should be noted that with the configuration shown in the figures, the ability is provided to monitor the tension and adjust the velocity of each pacing roll in the entire system. Accordingly, there is no longer a need to stage roll diameters progressively larger from one end of the press or web processing system to the other. This staging can be performed electronically in accordance with the present invention. Accordingly, a wide variety of different process heads may be fitted on individual base modules regardless of the roll diameters utilized in those processed heads. Specifically, diecut station process heads may be substituted where print station process heads had been previously located. Thus, assembly and retrofitting of stations is facilitated.

In accordance with the present invention, the pacing roll "gain" may be changed electronically through the web processing system for maximum efficiency, reduced waste and set-up time for each type of material to be run. The "gain" is determined for a standard system by how much the pacing rolls increase in diameter from the infeed and to the exit end of the press or web processing system. Typically, the "gain" for a system is optimized for one particular type of web material. Extensible films, for example, require little or no "gain" through the press or web processing system. In fact, gain applied to such extensible films will stretch the films beyond their yield point thus causing the film to be unusable and become scrap. Thicker materials run through the system with different optimized "gains." The present invention allows the press or web processing system to run virtually any material as the web without requiring a change of the pacing rolls, as required in the prior art.

The "gain" may be adjusted at each individual pacing daughter board 120 via a touch screen simply by inputting the diameter of the pacing roll for that pacing daughter board, along with a desired "gain." Alternatively, the pacing roll diameter for that pacing daughter board and the desired "gain" may be set at the main control module and then communicated to the pacing daughter board 100 via the local operating network bus.

Additionally, thermal changes in the press or web processing system will affect the pacing roll diameters, thereby changing the pacing applied to the web. This problem in the prior art is solved by the present invention by electronically compensating by adjusting the pace at each pacing roll to thereby minimize the thermal effects on the pacing. For example, as the web runs through a press or web processing system, especially if the press has a UV curing system without optimized temperature control, the rolls that contact the web will heat up causing the rolls to expand in diameter. As the rolls expand in diameter, they will pace at a higher rate causing more "gain" and more stretch of the material. The present invention allows adjustment for this change in roll diameters without requiring the rolls to cool or requiring the addition of very expensive temperature management devices. Specifically, the pacing at that roll may be automatically or manually adjusted based on an appropriate tension measurement $G_T$.

It can be seen that with this configuration utilizing drive rolls for the process head which are separate from the pacing rolls, and by utilizing a drive for the drive rolls which is separate from the drive for the pacing rolls, the option for throw control is maintained. This throw control option is available because the velocity of the main drive can be changed to match the caliper of the web to be run. Additionally, insetting is possible for the same reasons as the throw control. Accordingly, the present system is well suited to run all materials because pacing is not affected by a register change and throw is controlled. As noted above, thermal changes of the pacing roll diameters are easily corrected at each base module station. Additionally, with the present inventive design, the diameter of the pacing rolls is no longer critical and there is no need for staging of the pacing rolls. Thus, multiple webs can be introduced anywhere in the press and proper pacing adjusted and maintained. This control and these advantages are obtained because each base module uses transducers to constantly measure web tension and provide data to servo controllers to increase or decrease web speed and tension as needed to insure accurate web handling and print registry control.

The pacing control at each base module provides the ability to obtain modularity regardless of the size of the drive rolls in the process head.

Referring now to FIG. 3, an isolated VAC may be distributed via a printed circuit board mounted in each base module, with wiring to the next base module downstream being supplied with each base module. The connections 60 for the electrical power are shown in the figure. The isolated VAC electrical power is used at each base module to provide a linear 24 VDC and a 5 VDC power supply. The control wires may be routed between base modules 10, 12 and 14 by connecting to a distribution PCB mounted on the rear of each base module in a small distribution enclosure. A cable may be routed between the base module distribution enclosures. Each base module may be tied to ground via a ground strap running between an unpainted surface on the base module and a ground bar in a bus duct.

It can be seen in FIG. 1 that a variety of web path configurations may be set up within the base modules 10, 12, and 14 by disposing idler rolls 70 at appropriate locations within and without the base modules. The base module and tie bars 16 and 18 provide numerous mounting positions 70 for quick change idler rolls. The idler rolls may be moved to any desired position to suit the particular web path required at each base module. Typically, the center of the base module will be the center for all process heads, and thus will also be the normal center of the web. However, the web may run off-center if required. Also, it should be noted that although the pacing roll 36 is shown within the frame of each of the base modules, the pacing roll 36 could also be disposed at a location outside of the frame of the base modules.

Referring now to FIG. 1 and the portable process heads 22, 24 and 26, it can be seen that each head has a frame 80, and the before-mentioned drive roll 34. As noted previously, appropriate gearing is provided in each process head to mesh with gears 35 in the gear box 33 on the base module to obtain drive from the main drive shaft 32. Each of the portable process heads 22, 24 and 26 must also include an external surface 82 that includes therein an alignment registry structure 84 for mating in registry with the alignment structure 52 on the external surface 50 of the base module.

Figure 9:
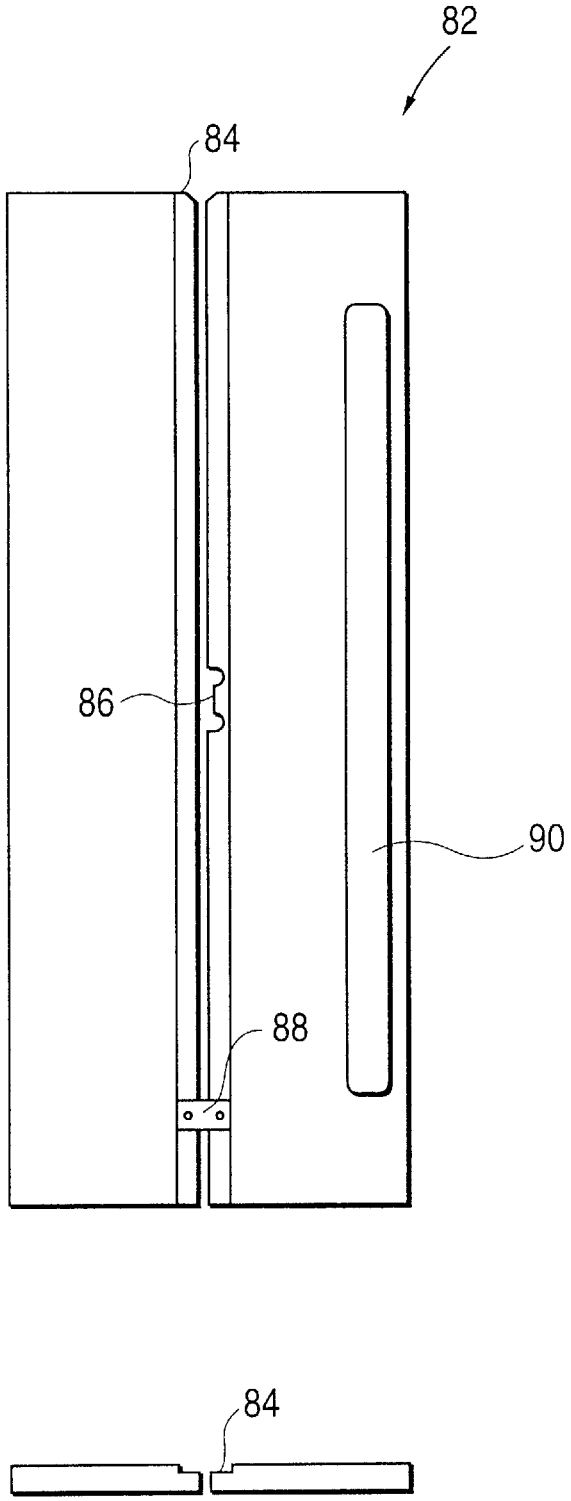
FIG. 9 is a view of one embodiment of an external surface for a process head.

One possible embodiment for the external surface 82 for the portable process head is shown in FIG. 9. FIG. 9 includes an alignment registry structure 84. In the embodiment shown in FIG. 9, this alignment registry structure comprises a slot in which the pins 52 on the base module may ride as the portable process head is slid into place. Additionally, an opening (not shown) may be formed in the side wall of the process head just above the entrance to the slot 84 to allow the cross-bar in the T-block 56 to slide in above the slot 84 to thereby prevent the process head from being lifted up and off of the external surface. Note that the slot 90 is an opening for the web.

Alternatively, the alignment registry structure 84 could be a protruding structure of some type designed to fit in a recessed alignment structure on the external surface 50 of the base module 10.

A recess 86 is formed in the alignment registry structure 84 to receive the electrical switch structure 54 from the base module 10. A positive stop 88 is disposed in the alignment structure to assist the operator in mating the portable process head to the base module.

Referring now to FIG. 10, details are shown of the electrical switch structure 54 and a switch 140 associated therewith. The electrical switch structure 54 is disposed in a frame structure 142 and is designed to protrude outwardly from the external surface 50 on the base module. The electrical switch structure 54 is dimensioned so that it will easily fit in the alignment registry structure or slot 84 in the external mating surface for the process head. The electrical switch 140 is disposed below the frame 142 with a mechanical actuator knob 144 protruding outwardly from the electrical switch 140 in adjacency with a surface 146 on the electrical switch structure 54.

A threaded screw member 148 is designed to be threaded into a threaded hole 150 in the frame 142 and also threaded into a threaded hole 152 in the electrical switch structure 54. The screw 148 may be rotated by means of a rachet handle 154 to thereby move the electrical switch structure 54 either to the left or to the right within the opening 143 in the frame 142.

Initially, the electrical switch structure 54 is disposed at its left-most position within the opening 148. In this initial position, the process head is aligned with the alignment structure 84 positioned so that the alignment pins 52 protrude into the slot 84 and the cross-bar for the T-structure 56 is disposed above the slot 84. The electrical switch structure 54 protrudes up through this slot 84 during this alignment positioning. When the process head has been positioned such that an alignment pin 52 is in contact with the end stop 88 on the external surface 82, then the ratchet handle 154 may be rotated to thereby rotate the screw 148 to move the electrical switch structure 54 to the right to seat in the recess 86 formed in the slot 84 (shown in FIG. 9). The movement of the electrical switch structure 54 out of contact with the knob 144 to the right operates to switch the electrical switch 140 to provide electrical power to the electrical power connectors 60, shown in FIG. 3. Specifically, this disengagement of the switch knob 144 causes the switch 140 to toggle to thereby provide power to the electrical connectors 60 in the base module. This toggling of the switch 140 applies power to a relay (not shown) to thereby connect power to the electrical connectors 60 for the base module. As the electrical switch structure 54 is moved to the right and into contact with the recess wall 86 in the slot 84 for the process head, the process head is moved slightly to the right to insure proper alignment of the process head gear to the gear 35 on the base module.

It can be seen from the foregoing alignment operation, that the electrical switch structure 54 insures that the electrical power is not provided until the process head is properly aligned on the external surface of the base module and the gears of the process head are engaged with the gears 35 on the base module. The T-member 56 on the external surface 50 of the base module insures that the process head is not pulled up and off of the base module without first disconnecting power to the process head.

During registry or mating, the portable process head is slid such that its external surface 82 slides in contact with the external surface 50 on the base module, and so that the alignment structures 52 ride in the recess 84. When one of the alignment pins 52 butts up against the positive stop 88, then the operator may rotate the threaded shaft shown in FIG. 9 to cause the portable process head to move laterally relative to the external surface 50 of the base module to receive the electrical switch structure in the recess 86. This lateral movement of the portable process head operates to trip the electrical switch connected to the electrical switch structure to thereby provide power to the portable process head. It should be noted that the process head may be conveniently bolted once it is properly mated. As noted previously, in order to prevent unsafe loading and unloading of the process head, the external surface for the process head is designed to also slide under two T-bars mounted on the base module surface as well as to provide a positive interlock to prevent movement of the process head with electrical power on. The positive stop is provided in the external surface of the process head to prevent over travel of the process head.

Figure 8:
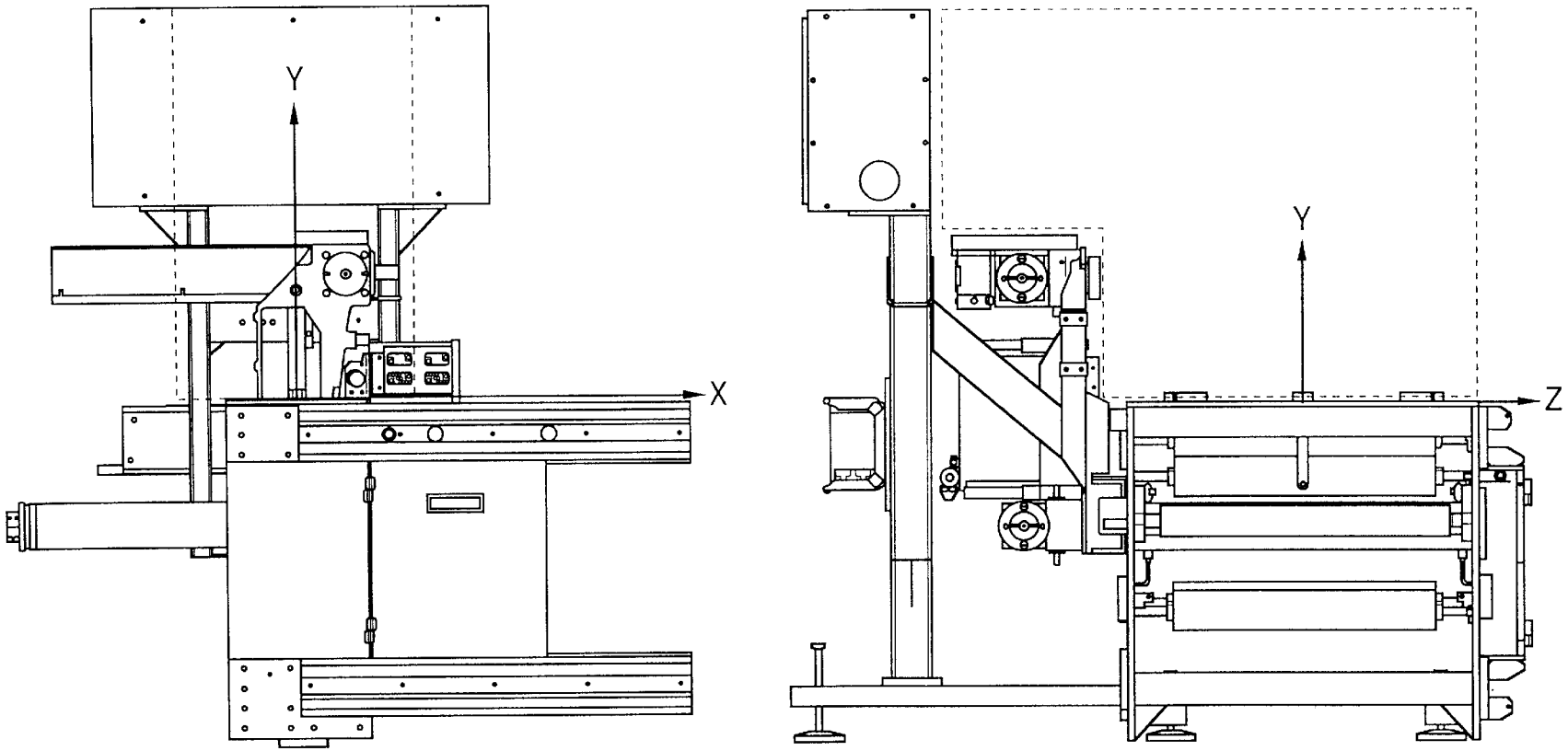
FIG. 8 shows two views of an embodiment of the present invention.

Referring now to FIG. 8, the dashed lines in each view shown in the figure illustrate the boundary area that may be occupied by a process head for the base module configuration shown in the figures. Modifications of the base module configuration can be provided in order to accommodate process heads that do not fit within these dashed line boundaries.

The present invention provides a variety of features which are advantageous for modularity. For example, process head alignment is accomplished by means of precision alignment structures (pins) in the external surface of the base module that accurately align the process head, rollers and gears and allow positioning on the positive stop 88 on the process head to prevent over travel and damage to the connections. Additionally, the teeth on the drive gears for both the base module and the process head are machined with an edge called "bullnosing" to insure engagement every time they are brought together. Also, the electrical connections and alignment structures are mechanically interlocked to prevent mechanical disconnection of the process head from the base module until all power has been removed, and to insure that reconnection has taken place before power can be replaced to the process head.

Additionally, the present design with its pacing control at each individual base module, allows the use of any process head, regardless of the size of its drive roll. All of these process heads have substantial identical interface structures to allow the interchange of process heads on base modules in any order in the web processing system.

With the above described invention, any process head can be removed and reinstalled in a completely different location within approximately five minutes per head with the use of a transport cart, overhead crane or other lifting device.

An important feature of the present invention is a unique distributed control system that recognizes which process head has been placed on which base module and reconfigures the icons on an operator control interface at the main control module accordingly.

Note that the external surface and alignment structure on the base module is designed to allow any other process head to be adapted easily to it. Thus, special heads may be developed and added to the web processing system at any time.

An important feature of the present invention is that multiple webs may be introduced at various points throughout the press or web processor and pacing from that point on can be adjusted electronically to compensate for the additional web thickness. This feature is beneficial because it no longer requires the change of pacing rolls from the point of entry of the second web to the exit end of the press.

Note that the present system allows for throw control. Throw control is the ability to vary the repeat length of an image to make it "throw" long or short depending on the needs for that particular job.

The present invention also permits infinitely variable repeat lengths. Specifically, this pacing control facilitates any repeat length to be matched. The system provides, in one embodiment, enough control to compensate more than 1/16" in either the plus or minus direction, thus allowing any repeat length to be matched exactly when using 1/8" circular pitch gearing.

The present system also permits insetting or re-insertion. Insetting or re-insertion is the ability to run a pre-printed or diecut web back through a press and perform more work on that web in register with the pre-printed image.

Accordingly it can be seen that the present invention provides a web processing system which can run a wide variety of materials with no compromise to set-up time and waste of material. This system offers complete versatility in presses with portable process heads or in situations where a variety of different work is to be performed on the web. Since some process heads can affect the pacing of the web, it is critical to have the web back under control as soon as possible in order to hold register.

Note that the present invention is of particular importance where the web must be taken up and down in the web track to perform a variety of different functions such as drying.

Obviously, many modifications and variations of the present invention are possible in light of the above teachings. It is therefore to be understood that within the scope of the appended claims, the invention may be practiced otherwise than as specifically described.

What is claimed is:

1. A reconfigurable web processor, comprising:

a first and a second base modules, each of said base modules including an external surface with at least one alignment structure disposed on said external surface;

a plurality of pacing rolls, with a different one of said plurality of pacing rolls associated with a different one of said base modules to adjust the pace of a web moving within said associated base module;

a plurality of transducers, with a different one of said plurality of transducers associated with a different one of said base modules and disposed to monitor a characteristic of said web at said associated base module and to generate a transducer signal in accordance therewith;

a plurality of pacing servos, with a different one of said plurality of pacing servos associated with each different one of said pacing rolls, each of said pacing servos to adjust the pace of said web in accordance with a different pacing control signal generated, and based, in part, on said transducer signal for its associated pacing roll; and a process head drive disposed to drive a drive roll in a portable process head that may be disposed on the respective external surface of said base modules in registry with said at least one alignment structure of said respective base modules.

2. A reconfigurable web process as defined in claim 1, further comprising:

a main control module connected to receive said transducer signal from said transducer at each of said base modules and operating to generate a different pacing control signal to said servo associated with each of said different pacing rolls to individually adjust the pacing of the web at each of said base modules.

3. A reconfigurable web process as defined in claim 1, further comprising:

a plurality of control modules, with a different one of said control modules associated with a different one of said base modules, each of said different control modules receiving said transducer signal from said associated transducer at said associated base module and operating to generate a pacing control signal and connected to apply said pacing control signal to said servo associated with said base module to adjust the pacing of the web at said associated base module.

4. A reconfigurable web processor as defined in claim 3, further comprising:

a main control module connected to receive said transducer signal from said transducer at each of said base modules and operative to generate a different pacing control signal to said servo associated with each of said different pacing roll to individually adjust the pacing of the web at each of said base modules.

5. A reconfigurable web processor as defined in claim 3, wherein each of said control modules includes a circuit to receive an input indicative of the diameter of said pacing roll associated with its associated base module and to receive an input indicative of a desired gain for said associated pacing roll, and wherein said control module generates said pacing control signal, based in part, on said diameter input and said desired gain input.

6. A reconfigurable web processor as defined in claim 1, further comprising:

a first portable process head for providing a first processing to said web, said first process head including a drive roll and an external surface and an alignment registry structure on said external surface for fitting in registry with said alignment structure of any of said base modules, said first portable process head disposed on said external surface of one said first and second base modules, with its registry structure fitted and in registry with said alignment structure of said base module;

a second portable process head for providing a second processing to said web, said second process head including an external surface and an alignment structure on said external surface for fitting in registry with said alignment structure of any of said base modules, said second portable process head disposed on said external surface of the other of said first and second base modules, with its registry structure fitted and in registry with said alignment structure of said other of said base modules.

7. A reconfigurable web processor as defined in claim 2, further comprising:

a first portable process head for providing a first processing to said web, said first process head including a drive roll and an external surface and an alignment registry structure on said external surface for fitting in registry with said alignment structure of any of said base modules, said first portable process head disposed on said external surface of one said first and second base modules, with its registry structure fitted and in registry with said alignment structure of said base module;

a second portable process head for providing a second processing to said web, said second process head including an external surface and an alignment structure on said external surface for fitting in registry with said alignment structure of any of said base modules, said second portable process head disposed on said external surface of the other of said first and second base modules, with its registry structure fitted and in registry with said alignment structure of said other of said base modules.

8. A reconfigurable web processor as defined in claim 3, further comprising:

a first portable process head for providing a first processing to said web, said first process head including a drive roll and an external surface and an alignment registry structure on said external surface for fitting in registry with said alignment structure of any of said base modules, said first portable process head disposed on said external surface of one said first and second base modules, with its registry structure fitted and in registry with said alignment structure of said base module;

a second portable process head for providing a second processing to said web, said second process head including an external surface and an alignment structure on said external surface for fitting in registry with said alignment structure of any of said base modules, said second portable process head disposed on said external surface of the other of said first and second base modules, with its registry structure fitted and in registry with said alignment structure of said other of said base modules.

9. A reconfigurable web processor as defined in claim 1, wherein said external surface on each of said base modules is a substantially horizontal top external surface of said base modules.

10. A reconfigurable web processor as defined in claim 1, wherein said pacing roll is disposed within said base module.

11. A reconfigurable web processor as defined in claim 1, wherein said at least one alignment structure comprises a plurality of pins protruding from said external surface.

12. A reconfigurable web processor as defined in claim 1, wherein each of said base modules further comprises an electrical switch structure for an electrical switch, said electrical switch structure disposed on said external surface and designed to switch said electrical switch to provide electrical power to said process head only when said portable process head is disposed on the external surface of said base module and aligned in registry with said at least one alignment structure.

13. A reconfigurable web processor as defined in claim 12, wherein said at least one alignment structure comprises a plurality of pins protruding from said external surface and disposed in line with said electrical switch structure.

14. A reconfigurable web processor as defined in claim 2, wherein each of said base modules further comprises an electrical switch structure for an electrical switch, said electrical switch structure disposed on said external surface and designed to switch said electrical switch to provide electrical power to said process head only when said portable process head is disposed on the external surface of said base module and aligned in registry with said at least one alignment structure.

15. A reconfigurable web processor as defined in claim 14, wherein said at least one alignment structure comprises a plurality of pins protruding from said external surface and disposed in line with said electrical switch structure.

16. A reconfigurable web processor as defined in claim 1, further comprising a plurality of idler rolls disposed in a track for said web.

17. A reconfigurable web processor defined in claim 1, further comprising:

a pacing drive shaft for driving each of said pacing rolls;

a plurality of pacing roll gear boxes, a different one of said plurality pacing roll gear boxes associated with a different one of said pacing rolls and connected to apply a drive from said pacing drive shaft to its associated pacing roll; and wherein said servo associated with each different one of said pacing rolls is operatively connected to said gear box associated with said pacing roll to adjust the pace of said web at said associated base module.

18. A reconfigurable web processor as defined in claim 1, wherein said process head drive comprises a main drive shaft operatively connected to drive a plurality of said drive rolls.

19. A reconfigurable web processor as defined in claim 2, further comprising:

a pacing drive shaft for driving each of said pacing rolls;

a plurality of pacing roll gear boxes, a different one of said plurality pacing roll gear boxes associated with a different one of said pacing rolls and connected to apply a drive from said pacing drive shaft to its associated pacing roll; and wherein said servo associated with each different one of said pacing rolls is operatively connected to said gear box associated with said pacing roll to adjust the pace of said web at said associated base module.

20. A reconfigurable web processor as defined in claim 19, wherein said process head drive comprises a main drive shaft operatively connected to drive a plurality of said drive rolls.

21. A reconfigurable web processor as defined in claim 3, further comprising:

a pacing drive shaft for driving each of said pacing rolls;

a plurality of pacing roll gear boxes, a different one of said plurality pacing roll gear boxes associated with a different one of said pacing rolls and connected to apply a drive from said pacing drive shaft to its associated pacing roll; and wherein said servo associated with each different one of said pacing rolls is operatively connected to said gear box associated with said pacing roll to adjust the pace of said web at said associated base module.

22. A reconfigurable web processor as defined in claim 21, wherein said process head drive comprises a main drive shaft operatively connected to drive a plurality of said drive rolls.

23. A reconfigurable web processor as defined in claim 1, wherein said process head drive comprises a plurality of servo motors, with a different one of said servo motors associated with each of said base modules to apply a drive to a drive roll in a portable process head.

24. A reconfigurable web processor comprising:

a first and a second base modules, each of said base modules including an external surface with at least one alignment structure disposed on said external surface, each of said base modules further including a pacing role, a servo operatively connected to adjust the pace of a web running on said pacing roll, and a transducer disposed to monitor the tension of said web running at said base module and to generate a transducer signal in accordance therewith;

a control module connected to receive said transducer signal from said transducer at each of said base modules and operating to generate and apply a different pacing control signal to each of said servos to individually adjust pacing of said web at said pacing roll at said base module;

a pacing drive shaft for driving said pacing roll at each of said base modules;

a process head drive shaft to drive a drive roll in a portable process head that may be disposed on the respective external surface of said base modules and in registry with said at least one alignment structure of said respective base modules.

25. A reconfigurable web processor as defined in claim 24, wherein said external surface on each of said base modules is a substantially horizontal top external surface of said base module.

26. A reconfigurable web processor as defined in claim 25, wherein each of said base modules further comprises an electrical switch structure for an electrical switch, said electrical switch structure disposed on said external surface and designed to switch said electrical switch to provide electrical power to said process head only when a portable process head is disposed on the external surface of said base module and aligned in registry with said at least one alignment structure.

27. A reconfigurable web processor comprising:

a first and a second base modules, each of said base modules including an external surface with at least one alignment structure disposed on said external surface, each of said base modules further including a pacing role, a servo operatively connected to adjust the pace of a web running on said pacing roll, and a transducer disposed to monitor the tension of said web running at said base module and to generate a transducer signal in accordance therewith;

a plurality of control modules, with a different control module associated with each of said base modules, each of said control modules receiving said transducer signal from said associated base module and operating to generate a pacing control signal and connected to apply said pacing control signal to said servo associated with said base module to adjust the pacing of the web at said base module;

a pacing drive shaft for driving said pacing roll at each of said base modules;

a process head drive shaft to drive a drive roll in a portable process head that may be disposed on the respective external surface of said base modules and in registry with said at least one alignment structure of said respective base modules.

28. A reconfigurable web processor as defined in claim 27, wherein each of said base modules further comprises an electrical switch structure for an electrical switch, said electrical switch structure disposed on said external surface and designed to switch said electrical switch to provide electrical power to said process head only when a portable process head is disposed on the external surface of said base module and aligned in registry with said at least one alignment structure.

29. A portable process head for providing processing to a web, comprising:

a frame;

a drive roll disposed within said frame for driving a web;

an external surface including an alignment registry structure therein for fitting in registry with an alignment structure on an external surface of a base module;

a recess formed in said alignment registry structure to receive an electrical switch structure from the base module which electrical switch structure is moved laterally relative to said external surface into said recess when in registry; and a positive stop disposed in said alignment structure.

30. A portable process head as defined in claim 29, wherein said external surface comprises a bottom external surface so that said portable process head may be disposed on top of a base module.

31. A method for automatically controlling the pacing in a modular web processor, comprising the steps of:

positioning a plurality of base modules to sequentially receive a continuous web;

mating portable process heads having substantially the same alignment structures thereon onto each of said plurality of base modules to process said web;

driving drive rolls in each of said portable process heads;

monitoring a characteristic of said web at each of said base modules and generating a first signal at each of said base modules in accordance therewith; and individually adjusting the pace of a pacing roll at each of said base modules in accordance with an individual control signal generated for that pacing roll based, in part, on said first signal generated at said base module.

32. A method as defined in claim 31, wherein said driving drive rolls step comprises the step of driving said drive rolls from a single main shaft.

33. A method as defined in claim 32, wherein said adjusting the pace step comprises the step of driving each of said pacing rolls from a single pacing drive shaft; and adjusting a gear box that is disposed to operatively apply the drive from the pacing drive shaft to each of said pacing rolls to individually adjust the pace of said pacing rolls.

34. A method as defined in claim 33, wherein the completion of said process head mating step for one of said base modules automatically switches electrical power to said process head.

35. A method as defined in claim 31, wherein said adjusting the pace step comprises the step of driving each of said pacing rolls from a single pacing drive shaft; and adjusting a gear box that is disposed to operatively apply the drive from the pacing drive shaft to each of said pacing rolls to individually adjust the pace of said pacing rolls.

36. A method as defined in claim 31, wherein said individually adjusting the pace step comprises the step of receiving said first control signals from said plurality of base modules at a central control module and generating and applying said individual pacing control signals to each of said base modules to individually adjust the pace of said pacing roll thereat.

37. A method as defined in claim 31, wherein said individually adjusting the pace step comprises the step of receiving said first control signal at a different control module associated with a different one of said base modules and generating and applying said individual pacing control signal to said associated base module to adjust the pace of said pacing roll thereat.

38. A method as defined in claim 31, wherein each of said base modules and each of said process heads includes at least one functional control module; and further comprising the step of causing each of said functional control modules to generate and send to a main control module an ID signal identifying itself and a signal identifying what other of said functional control modules that said each functional control module will communicate with; and a step of generating an indication of whether an overall system resulting from said process head mating step is functional based on at least said signals from said functional control modules.

39. A method for automatically controlling the pacing in a modular web processor, comprising the steps of:

positioning a plurality of base modules to sequentially receive a continuous web;

mating portable process heads having substantially the same alignment structures thereon onto each of said plurality of base modules to process said web, wherein each of said base modules and each of said process heads includes at least one functional control module;

causing each of said functional control modules to generate and send to a main control module an ID signal identifying itself and a signal identifying what other of said functional control modules that said each functional control module will communicate with; and generating an indication of whether an overall system resulting from said process head mating step is functional based on at least said signals from said functional control modules.

40. A reconfigurable web processor, comprising:

a first and a second base modules, each of said base modules including an external surface with at least one alignment structure disposed on said external surface;

a plurality of pacing rolls, with a different one of said plurality of pacing rolls associated with a different one of said base modules to adjust the pace of a web moving within said associated base module;

a plurality of transducers, with a different one of said plurality of transducers associated with a different one of said base modules and disposed to monitor a characteristic of said web at said associated base module and to generate a transducer signal in accordance therewith;

a plurality of pacing servos, with a different one of said plurality of pacing servos associated with each different one of said pacing rolls, each of said pacing servos to adjust the pace of said web in accordance with a different pacing control signal generated, and based, in part, on said transducer signal for its associated pacing roll; and a first portable process head for providing a first processing to said web, said first process head including an external surface and an alignment registry structure on said external surface for fitting in registry with said alignment structure of any of said base modules, said first portable process head disposed on said external surface of one said first and second base modules, with its registry structure fitted and in registry with said alignment structure of said base module;

a second portable process head for providing a second processing to said web, said second process head including an external surface and an alignment structure on said external surface for fitting in registry with said alignment structure of any of said base modules, said second portable process head disposed on said external surface of the other of said first and second base modules, with its registry structure fitted and in registry with said alignment structure of said other of said base modules a central control module connected to electronically communicate with each of said base modules and with each of said process heads;

wherein each of said base modules includes at least one functional control module;

wherein each of said process heads includes at least one functional control module;

further comprising a control system operative on power-up of the system, to cause each of said functional control modules in said system to generate and send to said main control module an ID signal identifying itself to said main control module and to generate and send a signal identifying what other of said functional control modules that said each functional control module will communicate with;

wherein said central control module is operative to generate an indication of whether said web processor is functional based on at least said signals from said functional control modules.

41. A reconfigurable web processor, comprising:

a first and a second base modules, each of said base modules including an external surface with at least one alignment structure disposed on said external surface;

a first portable process head for providing a first processing to said web, said first process head including an external surface and an alignment registry structure on said external surface for fitting in registry with said alignment structure of any of said base modules, said first portable process head disposed on said external surface of one said first and second base modules, with its registry structure fitted and in registry with said alignment structure of said base module;

a second portable process head for providing a second processing to said web, said second process head including an external surface and an alignment structure on said external surface for fitting in registry with said alignment structure of any of said base modules, said second portable process head disposed on said external surface of the other of said first and second base modules, with its registry structure fitted and in registry with said alignment structure of said other of said base modules;

a central control module connected to electronically communicate with each of said base modules and with each of said process heads;

wherein each of said base modules includes at least one functional control module;

wherein each of said process heads includes at least one functional control module;

further comprising a control system operative on power-up of the system, to cause each of said functional control modules in said system to generate and send to said main control module an ID signal identifying itself to said main control module and to generate and send a signal identifying what other of said functional control modules that said each functional control module will communicate with;

wherein said central control module is operative to generate an indication of whether said web processor is functional based on at least said signals from said functional control modules.

* * * * *